US012630961B2

(12) United States Patent
Huang et al.

(10) Patent No.: US 12,630,961 B2
(45) **Date of Patent: *May 19, 2026**

(54) EJECTOR, DISPENSING DEVICE AND LAUNDRY TREATMENT APPLIANCE

(71) Applicants: QINGDAO HAIER LAUNDRY ELECTRIC APPLIANCES CO., LTD., Qingdao (CN); HAIER SMART HOME CO., LTD., Qingdao (CN)

(72) Inventors: Tao Huang, Qingdao (CN); Baozhen Cheng, Qingdao (CN); Huacheng Zhang, Qingdao (CN)

(73) Assignees: QINGDAO HAIER LAUNDRY ELECTRIC APPLIANCES CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 126 days.

This patent is subject to a terminal disclaimer.

(21) Appl. No.: 18/293,394

(22) PCT Filed: Jun. 21, 2022

(86) PCT No.: PCT/CN2022/100074

§ 371 (c)(1),
(2) Date: Jan. 30, 2024

(87) PCT Pub. No.: WO2023/005510

PCT Pub. Date: Feb. 2, 2023

(65) Prior Publication Data

US 2024/0279863 A1 Aug. 22, 2024

(30) Foreign Application Priority Data

Jul. 30, 2021 (CN) ..... 202110868914.X
Jul. 30, 2021 (CN) ..... 202110868931.3
(Continued)

(51) Int. Cl.
*D06F 39/02* (2006.01)
*D06F 39/08* (2006.01)

(52) U.S. Cl.
CPC ..... *D06F 39/02* (2013.01); *D06F 39/028* (2013.01); *D06F 39/08* (2013.01); *D06F 39/088* (2013.01)

(58) Field of Classification Search
CPC ..... D06F 39/088; D06F 39/02; D06F 39/08; D06F 39/028
See application file for complete search history.

(56) References Cited

U.S. PATENT DOCUMENTS 3,174,489 A * 3/1965 Jellies ..... D06F 39/087 200/83 Z
3,862,640 A * 1/1975 Hechler, IV ..... E03C 1/108 137/1
(Continued)

FOREIGN PATENT DOCUMENTS

CN 104562566 A * 4/2015 ..... D06F 37/00
CN 105862349 A 8/2016
(Continued)

OTHER PUBLICATIONS

PCT/CN2022/100074 International Search Report; Aug. 29, 2022.

*Primary Examiner* — Benjamin L Osterhout
(74) *Attorney, Agent, or Firm* — Sand, Sebolt & Wernow Co., LPA

(57) ABSTRACT

An ejector for a laundry treatment appliance, a dispensing device and a laundry treatment appliance is disclosed. The ejector has a front chamber portion, a connection portion and a rear chamber portion connected in sequence. A flow channel is provided in the front chamber portion. The connection portion has a gap which communicates the flow channel with the outside atmosphere. An ejection hole of a water outlet end of the front chamber portion allows water
(Continued)

to flow into an injection hole of a water inlet end of the rear chamber portion via the connection portion. The rear chamber portion includes a variable-diameter flow channel with a cross-sectional dimension gradually increasing in a direction of water flow. Backflow water is discharged from the gap of the ejector. The variable-diameter flow channel is arranged downstream of the gap and thereby prevens water flowing back into an upstream tap water pipe.

17 Claims, 9 Drawing Sheets

(30) Foreign Application Priority Data

Jul. 30, 2021 (CN) ..... 202110868937.0
Jul. 30, 2021 (CN) ..... 202110868940.2

(56) References Cited

U.S. PATENT DOCUMENTS 5,522,419 A * 6/1996 Sand ..... B01F 25/31243 137/216
9,409,134 B1 * 8/2016 Jones ..... B01F 25/312
2005/0252549 A1 * 11/2005 Hague ..... B01F 25/312 137/216
2009/0000024 A1 * 1/2009 Louis ..... E03C 1/046 222/1
2012/0024021 A1 * 2/2012 Seo ..... D06F 39/028 137/215
2014/0102543 A1 * 4/2014 Grant ..... B01F 35/75441 137/115.11

FOREIGN PATENT DOCUMENTS

CN 207324530 U 5/2018
CN 111032948 A 4/2020
CN 111286933 A 6/2020
CN 111455619 A 7/2020
EP 2860301 A1 * 4/2015 ..... D06F 37/00
JP 2004331088 A * 11/2004 ..... B67D 1/0086
JP 2008154863 A 7/2008
JP 2015100720 A 6/2015
WO WO-2019044305 A1 * 3/2019 ..... D06F 39/08

* cited by examiner

EJECTOR, DISPENSING DEVICE AND LAUNDRY TREATMENT APPLIANCE

FIELD

The present disclosure relates to the field of laundry treatment appliance, in particular to an ejector applied to a water supply waterway of laundry treatment appliance, and also relates to a dispensing device having a function of supplying water to the laundry treatment appliance, in particular to a dispensing device equipped with the ejector.

BACKGROUND

With the development of the economic level, washing appliance is used in most users' homes. With the improvement of living standards, washing appliance not only has a single washing function, but also has many other functions, such as drying and ironing. The washing appliance with various functions is collectively referred to as laundry treatment appliance.

However, regardless of any function, the laundry treatment appliance is generally provided with a dispensing device, so that different water supply waterways arranged on the dispensing device can be used to supply water to different components, where water is needed, of the laundry treatment appliance. Meanwhile, the dispensing device of the existing laundry treatment appliance is provided with a dispensing chamber for dispensing one or more additives, so that the additives in the dispensing chamber can be dispensed correspondingly along with the different water supply waterways arranged on the dispensing device so as to realize different laundry treatment functions of the laundry treatment appliance.

However, the existing dispensing device has the following problems in structure.

In supplying water in the laundry treatment appliance, when situations such as damage of a water inlet tap, falling of a water inlet pipe, and cutting off water supply to a user's home happen, a negative pressure may be generated at the water inlet pipe of the laundry treatment appliance. In particular, when the water supply is cut off in the user's community and the user is located at a too high floor level, a negative pressure is generated in the tap water supply pipeline of the user, so that the water flow mixed with the additives in the water supply waterway of the laundry treatment appliance flows reversely to the tap water pipe, thereby causing contamination to the water supply source of the user's home.

In the prior art, a one-way check valve is generally arranged at the water inlet of the water supply waterway of the laundry treatment appliance to solve the above-mentioned problems. But the one-way check valve has a possibility of failure, to cause the water supply system of the entire laundry treatment appliance to be unreliable.

In view of this, the present disclosure is provided to solve the above problems.

SUMMARY

The present disclosure provides an ejector and a dispensing device with the ejector to allow the pressurized fluid to flow and prevent from flowing back. A laundry treatment appliance with the above dispensing device provided with the ejector is provided, to reduce the pressure of the backflow of pressurized water flow and prevent the backflow of pressurized water flow from flowing into a tap water supply pipeline through a backflow-preventing gap.

In order to achieve the above object of the disclosure, the specific solutions adopted by the present disclosure are as follows.

An ejector for a laundry treatment appliance, comprises, a flow channel allowing water flow to flow through and formed by a front chamber portion, a connection portion and a rear chamber portion which are connected in sequence. The connection portion is provided with a gap for communicating the flow channel with the outside atmosphere. A water outlet end of the front chamber portion is provided with an ejection hole for allowing water to flow directly into the rear chamber portion through the connection portion. A water inlet end of the rear chamber portion is provided with an injection hole for receiving the water flow from the ejection hole. The rear chamber portion is provided with a variable-diameter flow channel with the cross-sectional dimension gradually increasing in a direction of water flow.

Further, the ejection hole and the injection hole are coaxial with each other, and the water flow flowing out of the ejection hole flows directly into the injection hole through the connection portion. When the water flow flows through the connection portion, the water flow passes over the gap on the connection portion and flows directly into the injection hole by means of itself water pressure.

Further, the connection portion is a shape of a cylinder, the front chamber portion and the rear chamber portion are respectively located at two ends of the cylindrical structure, and the ejection hole of the front chamber portion and the injection hole of the rear chamber portion are both coaxial with or in parallel with an axis of the connection portion with a shape of the cylinder. One side of the connection portion is provided with a notch as a gap for communicating the flow channel with the outside atmosphere. Preferably, a diameter of the connection portion is greater than diameters of the injection hole and the ejection hole.

Further, the connection portion is extended in a horizontal direction, and the notch formed on a sidewall of the connection portion faces downward. The axes of the injection hole and the ejection hole are arranged above the axis of the connection portion.

Further, the variable-diameter flow channel is a first conical flow channel extending in the direction of the axis of the injection hole. A small mouth end of the first conical flow channel is connected with and coaxial with the injection hole, and the diameter of the injection hole is same with the diameter of the small mouth end of the first conical flow channel. A large mouth end of the first conical flow channel is connected with a water outlet of the ejector located on the side of the rear chamber portion away from the connection portion.

Preferably, a diameter of the large mouth end of the first conical flow channel is greater than the diameter of the ejection hole, and smaller than or equal to a diameter of the cylindrical connection portion.

Further, the front chamber portion is formed by a second conical flow channel gradually narrowing in a direction of water flow, for pressurizing the water flow flowing out from the ejection hole.

Preferably, a small mouth end of the second conical flow channel is connected with and coaxial with the ejection hole of the front chamber portion, and a diameter of small mouth end is same with a diameter of ejection hole. A large mouth end of the second conical flow channel is located on the side of the front chamber portion away from the connection portion and forms a water inlet of the ejector.

Further, a cross-sectional area of the injection hole is equal, or approximately equal, to a cross-sectional area of the ejection hole.

Preferably, the cross-sectional area of the injection hole is slightly smaller than the cross-sectional area of the ejection hole.

Further preferably, the injection hole and the ejection hole are circular holes being coaxial, and the diameter of the injection hole is smaller than the diameter of the ejection hole and greater than seven tenths of the diameter of the ejection hole.

Further, the front chamber portion, the connection portion, and the rear chamber portion are coaxially arranged to form an integral piece.

Preferably, a first support portion is formed at a place where the front chamber portion is connected with the connection portion of the ejector, and a second support portion is formed at a place where the rear chamber portion is connected with the connection portion. Both a periphery of the first support portion and a periphery of the second support portion are provided with at least one sealing ring respectively, and the gap on the ejector is located between the first support portion and the second support portion.

The present disclosure also provides a dispensing device. The dispensing device is provided with a water supply waterway, and the above ejector is arranged in is the water supply waterway.

The present disclosure also provides a laundry treatment appliance. The above dispensing device is arranged in the laundry treatment appliance.

The present disclosure has significant technical advantages over the prior art as follows.

According to the present disclosure, by the arrangement of the gap for communicating the flow channel with the outside atmosphere, the backflow water is discharged from the gap of the ejector, to preventing water in the waterway in which the ejector is arranged from flowing back. The variable-diameter flow channel widening in the direction of the inlet water flow is arranged downstream of the gap of the ejector, to hinder water to flow back, thereby reducing the flow rate of the backflow water into the connection portion, and further reducing the possibility of the backflow water to flow into the front chamber portion of the ejector. The backflow water is effectively prevented from flowing back into the upstream tap water pipe to contaminate the upstream tap water pipe.

The present disclosure provides a dispensing device, to achieve the object of sharing the same ventilation structure by different water supply waterways. The present disclosure provides a dispensing device, in which a high-pressure water supply waterway is provided with a ejector to prevent pressure relief of a pressurized inlet water flow.

In order to achieve the above object of the disclosure, the specific solutions employed by the present disclosure are as follows.

The disclosure provides a dispensing device, comprises:

a first water supply waterway, configured to supply high-pressure water;

a second water supply waterway, configured to supply low-pressure water; wherein the first water supply waterway is provided with a backflow-preventing gap, for discharging backflow water in the first water supply waterway; and the second water supply waterway is provided with a ventilation port, the ventilation port is communicated with a water inlet chamber inside the dispensing device through a ventilation passage, and the backflow-preventing gap is communicated with the ventilation passage for enabling backflow water to flow into the water inlet chamber through the ventilation passage.

Further, the first water supply waterway is provided with the ejector allowing water flow to flow through, the ejector is provided with a backflow-preventing gap, and the backflow-preventing gap is used for communicating the flow channel inside the ejector with the ventilation passage.

Preferably, the ejector is provided with a variable-diameter flow channel located downstream of the backflow-preventing gap and having the cross-sectional dimension gradually increasing in the direction of water flow.

Further, the dispensing device includes a water box, and an inner space of the water box forms a water inlet chamber communicating with the outside atmosphere. The ventilation passage, the first water supply waterway, and the second water supply waterway are integrally arranged on an upper cover at a top of the water box. One end of the ventilation passage communicates with the water inlet chamber, and the other end of the ventilation passage communicates with the ventilation port of the second water supply waterway.

Preferably, the ejector is a separate component and mounted in the first water supply waterway. Alternatively, the ejector may be integrated into the first water supply waterway and integrated with an upper cover of the first water supply waterway of the dispensing device.

Further, the first water supply waterway includes a first water inlet chamber, a mounting chamber and a first water outlet chamber, the ejector is mounted in the mounting chamber, and a water inlet and a water outlet of the ejector respectively communicate with the first water inlet chamber and the first water outlet chamber. The ejector is provided with a backflow-preventing gap, and the backflow-preventing gap faces downward and communicates with the ventilation passage below the gap.

Preferably, an inlet of the first water inlet chamber communicates with a water inlet valve through a first water inlet pipeline. An axis of the ejector is horizontally extended, and the ejector is mounted above the first water inlet chamber and on one side of the first water outlet chamber. The water inlet of the ejector communicates with an outlet of the first water inlet chamber through the mounting chamber. A water outlet of the ejector communicates with the first water outlet chamber extending coaxially with the water outlet. An end of the first water outlet chamber is provided with a first water outlet connector which is coaxial with the ejector and allows water flow to flow out of the dispensing device.

Further, the second water supply waterway includes a second water inlet chamber, a water passing chamber and a second water outlet chamber; an inlet of the second water inlet chamber communicates with a water inlet control valve through a second water inlet pipeline, the water passing chamber is arranged above the second water inlet chamber, the water passing chamber is provided with a water passing inlet and a water passing outlet, and the water passing inlet communicates with the outlet arranged at the top of the second water inlet chamber. The second water outlet chamber is arranged below the water passing chamber and on one side of the first water outlet chamber, the water passing outlet communicates with the top of the second water outlet chamber, and the bottom of the water passing chamber is provided with a second water outlet connector that allows water flow to flow out of the dispensing device.

Further, the top of the side wall of the second water outlet chamber of the second water supply waterway is provided with a ventilation port. The ventilation passage is extended horizontally and is arranged at one side of the second water outlet chamber, and the ventilation port communicates with one end of the ventilation passage, and the other end of the ventilation passage is provided with an opening communicating with the water inlet chamber below.

Further, the ejector in the first water supply waterway is located above the opening of the ventilation passage, and the gap on the ejector faces downward and corresponds to the opening below, for directly communicating the gap of the ejector with the water inlet chamber of the water box through the opening.

Further, the upper cover of the dispensing device is formed by connecting an upper cover plate with a lower cover plate by a snap-fitting manner. The first water inlet chamber of the first water supply waterway, and the second water inlet chamber and the second water outlet chamber of the second water supply waterway are arranged between the upper cover plate and the lower cover plate, and the ejector and the first water outlet chamber of the first water supply waterway and the water passing chamber of the second water supply waterway are arranged at the upper side of the upper cover plate and upward protruded.

The ventilation passage is arranged between the upper cover plate and the lower cover plate, and communicates with the backflow-preventing gap on the ejector of the first water supply waterway above and the second water outlet chamber of the second water supply waterway adjacent to the ventilation respectively.

A further object of the present disclosure is to provide laundry treatment appliance, including the above dispensing device.

The first water supply waterway of the dispensing device communicates with a washing structure in the laundry treatment appliance to supply high-pressure inlet water to the washing structure for flushing lint on a lint filter.

The second water supply waterway communicates with a condenser in the laundry treatment appliance, and supplies low-pressure inlet water to the condenser for heat exchange.

Further, inlets of the first water supply waterway and the second water supply waterway of the dispensing device communicate with outlets of different water inlet valves in a one-to-one relationship, and inlets of the water inlet valves communicate with the water inlet of the laundry treatment appliance.

The present disclosure has significant technical advantages over the prior art as follows.

According to the present disclosure, the ventilation openings arranged on the two different water supply waterways communicate with the outside atmosphere through the same ventilation passage, so that different water supply waterways of the dispensing device share the same ventilation passage, thereby simplifying the structure of the dispensing device. In the present disclosure, the backflow-preventing gap of the ejector arranged on the high-pressure water supply waterway is directly communicated with the ventilation passage, so that not only the water flow in the high-pressure waterway connected with the ventilation passage is prevented from relieving pressure by using the characteristics of the ejector, but also the backflow water flowing out from the gap flows through the ventilation passage into the water inlet chamber of the dispensing device.

The present disclosure provides a dispensing device. Water supply waterways are arranged in different levels of the dispensing device, thereby stabilizing the inlet water flow and regulating the pressure of the inlet water flow of the water supply waterway. The present disclosure also provides a dispensing device in which the water supply waterway is provided with an ejector to prevent the pressurized inlet water from flowing backflow.

In order to achieve the above object of the disclosure, the specific solutions adopted by the present disclosure are as follows.

A dispensing device, includes, a water supply waterway; the water supply waterway is provided with a water inlet chamber and a water outlet chamber at different levels, and a water inlet chamber communicates with the water outlet chamber via the ejector.

Further, the ejector is arranged in the same level as the water outlet chamber; the water inlet chamber communicates with a water inlet of the ejector via the mounting chamber, and a water outlet of the ejector communicates directly with the water outlet chamber.

Further, the ejector is arranged in the mounting chamber, and a periphery of the ejector is provided with a sealing ring hermetically contact with the inner wall of the mounting chamber, for dividing the mounting chamber into two separate parts. The upstream part of the mounting chamber communicates with the water inlet chamber and the water inlet of the ejector.

Further, the water inlet chamber is arranged lower than the water outlet chamber, and a bottom of one end of the water inlet chamber communicates with a water inlet connector of the dispensing device, and a top of another end is provided with an outlet communicating with the water inlet of the ejector.

Preferably, a bottom of an upstream part of the water passing chamber communicates with the outlet of the water inlet chamber.

Further, the water outlet chamber is coaxial with the ejector, and two ends of the water outlet chamber respectively communicate the water outlet of the ejector and a water outlet connector of the dispensing device.

Further, the dispensing device includes a water box, a top wall of the water box is formed by an upper cover, and the water supply waterway is integrally arranged on the upper cover.

The upper cover is formed by connecting an upper cover plate with a lower cover plate by a snap-fitting manner, the water outlet chamber and the ejector are arranged on the upper cover plate and upward protruded, and the water inlet chamber is arranged between the upper cover plate and the lower cover plate.

Further, the ejector is provided with a gap for discharging the backflow water in the water supply waterway. The dispensing device is provided with a ventilation passage communicating with the atmosphere, the ventilation passage is arranged at the same level as the water inlet chamber, and the gap on the ejector directly communicates with the ventilation passage.

Further, the ventilation passage is arranged between the upper cover plate and the lower cover plate of the upper cover of the dispensing device, and at least part of the ventilation passage is arranged below the gap of the ejector. The gap on the ejector directly communicates with the ventilation passage below via an opening formed on the upper cover plate.

Further, the ventilation passage is provided with an opening located below the gap of the ejector, and the opening enables the ventilation passage to communicate with a water inlet chamber inside the water box. The water inlet chamber is provided with an opening at the front end of the water box for enabling the ventilation passage to communicate with the outside atmosphere through the water inlet chamber.

It is a further object of the present disclosure to provide laundry treatment appliance with the above dispensing devices.

The present disclosure has significant technical advantage over the prior art as follows.

According to the present disclosure, by using the height difference of the water supply waterway of the dispensing device, water flowing in the water supply waterway flows from a lower position to a higher position to automatically adjust the pressure of the water flowing, so the pressure of the outlet water flow of the water supply waterway is stabilized and it is improved the stability of flowing out of the water supply waterway. Further, by arranging the ejector on the water supply waterway, the waterways in different levels are communicated by the ejector, and the backflow is prevented in the water supply waterway by the backflow-preventing gap arranged on the ejector.

The present disclosure provides a dispensing device, to allow the pressurized fluid to flow and prevent from flowing back. Meanwhile, a laundry treatment appliance with the above dispensing device is provided, to maintain the pressure in the waterway downstream of the backflow-preventing gap and prevent the inlet water flow from relieving pressure after passing over the backflow-preventing gap.

In order to achieve the above object of the disclosure, the specific solutions adopted by the present disclosure are as follows.

The present disclosure provides a dispensing device including a water supply waterway; the water supply waterway is provided with a backflow-preventing gap communicating with the outside atmosphere. The water supply waterway is provided with an ejection hole located on an upstream side of the backflow-preventing gap and an injection hole located on a downstream side of the backflow-preventing gap, a center line of the ejection hole is coaxial with a center line of the injection hole, and a diameter of the ejection hole is approximately equal to a diameter of the injection hole.

Further, the water supply waterway is provided with a straight flow channel segment with an axis extending in a straight line, and a side wall of the straight flow channel segment is provided with a notch, and the notch for communicating the water supply waterway with the outside atmosphere is as the backflow-preventing gap.

Further, the water supply waterway is internally provided with a front end wall located upstream of the backflow-preventing gap and a rear end wall located downstream of the backflow-preventing gap, the ejection hole is formed in the front end wall, and the injection hole is formed in the rear end wall.

Preferably, the front end wall and the rear end wall are all perpendicular to the axis of the straight flow channel segment.

Further, the axis of the straight flow channel segment coincides with, or is parallel to, the axes of the injection hole and the ejection hole.

Preferably, centers of the ejection hole and the injection hole are arranged substantially at the center axis of the straight flow channel segment, and the diameter of the injection hole is slightly smaller than the diameter of the ejection hole.

Preferably, a difference between the diameters of the injection hole and the ejection hole is smaller than or equal to one fifth of the diameter of the injection hole.

Further preferably, the difference between the diameters of the injection hole and the ejection hole is smaller than or equal to one tenth of the diameter of the injection hole.

Further, the water supply waterway is provided with a water inlet flow channel segment arranged on an upstream of the front end wall, and the water inlet flow channel segment communicates with and is coaxial with the ejection hole.

The water inlet flow channel segment is a narrowed flow channel with the cross-sectional area gradually decreasing in a direction from the water inlet to the ejection hole.

Preferably, a first flow channel segment with invariable diameter is arranged between a small mouth end of the water inlet flow channel segment and the end face of the ejection hole, and a large mouth end of the water inlet flow channel segment is connected with a second flow channel segment with invariable diameter.

Further, the water supply waterway is provided with a water outlet flow channel segment arranged on a downstream of the rear end wall, and the water outlet flow channel segment is communicated with and coaxial with the injection hole.

The water outlet flow channel segment is a flow channel with variable diameter with the cross-sectional dimension gradually increasing in the direction of water flow.

The small mouth end of the water outlet flow channel segment communicates with the injection hole, and the large mouth end of the water outlet flow channel segment communicates with the downstream waterway.

Preferably, a flow channel segment with invariable diameter and/or a flow channel segment narrowed in the direction of the water flow is arranged between the small mouth end of the water outlet flow channel segment and the end face of the injection hole.

Further, the water supply waterway is provided with a water inlet chamber and a water outlet chamber located at different levels. The water inlet chamber communicates with the backflow-preventing gap through the ejection hole, and the water outlet chamber communicates with the backflow-preventing gap through the injection hole, for injecting the water flow in the water inlet chamber into the water outlet chamber to form a waterway.

Preferably, the mounting chamber is in a shape of strip, and the middle of the mounting chamber with a shape of strip is the straight flow channel segment of which the side wall is provided with a notch to form the backflow-preventing gap. The front end wall with the ejection hole and the rear end wall with the injection hole are arranged at the two ends of the straight flow channel segment. The mounting chamber on the upstream side the front end wall forms the water inlet flow channel segment, and the mounting chamber on the downstream of the rear end wall forms the water outlet flow channel segment.

Further, the dispensing device includes a water box, wherein a top wall of the water box is formed by the upper cover, and the water supply waterway is integrally arranged on the upper cover. The upper cover is formed by connecting the upper cover plate with the lower cover plate in a snap-fitting manner. The water outlet chamber and the mounting chamber are formed on the upper cover plate and upward protruded, the mounting chamber is open at one end to communicate with the water outlet chamber, and the injection hole is arranged between the open end and the backflow-preventing gap. The water inlet chamber is arranged between the upper cover plate and the lower cover plate. The other end of the mounting chamber is closed, the bottom of the mounting chamber is provided with a through hole communicating with the water inlet chamber below, and the ejection hole is arranged between the closed end and the backflow-preventing gap.

Further, a second water supply waterway is also provided, and the second water supply waterway is provided with a ventilation port. The ventilation port communicates with the water inlet chamber formed in the dispensing device through a ventilation passage, and the backflow-preventing gap communicates with the ventilation passage for enabling the backflow water to flow into the water inlet chamber through the ventilation passage. Preferably, the front end of the water inlet chamber is open and communicates with the atmosphere, and the backflow-preventing gap communicates with the outside atmosphere through the ventilation passage and the water inlet chamber.

The present disclosure also provides laundry treatment appliance, and the laundry treatment appliance is provided with the dispensing device as described above.

The present disclosure has significant technical advantages over the prior art as follows.

According to the present disclosure, by arranging the gap on the water supply waterway communicating with the outside atmosphere, the backflow water is discharged from the ejector, so it is prevented from flowing back in a waterway. By providing the injection hole and the ejection hole which are oppositely arranged on the water supply waterway, and the diameters of the injection hole and the ejection hole are equal to each other, so that the water flow injected into the injection hole covers the injection hole as much as possible. The water inlet end of the waterway downstream of the injection hole is not open, so as to maintain the pressure of the inlet water flow and prevent the water flow in the waterway downstream of the gap from relieving pressure under the action of the gap during water inlet.

The present disclosure is simple in structure, remarkable in effect, and suitable for widespread use.

Specific embodiments of the disclosure will be described in further detail below with reference to the accompanying drawings.

BRIEF DESCRIPTION OF THE DRAWINGS

The accompanying drawings are incorporated in and constitute a part of this disclosure for further understanding the disclosure, illustrative embodiments of the disclosure and the description thereof are provided for explaining the disclosure, but are not to be construed as unduly limiting of the disclosure. Apparently, the accompanying drawings in the following description are merely some embodiments, for a skilled person in the art, other drawings can also be obtained according to these accompanying drawings without paying no creative labor.

Figure 1:
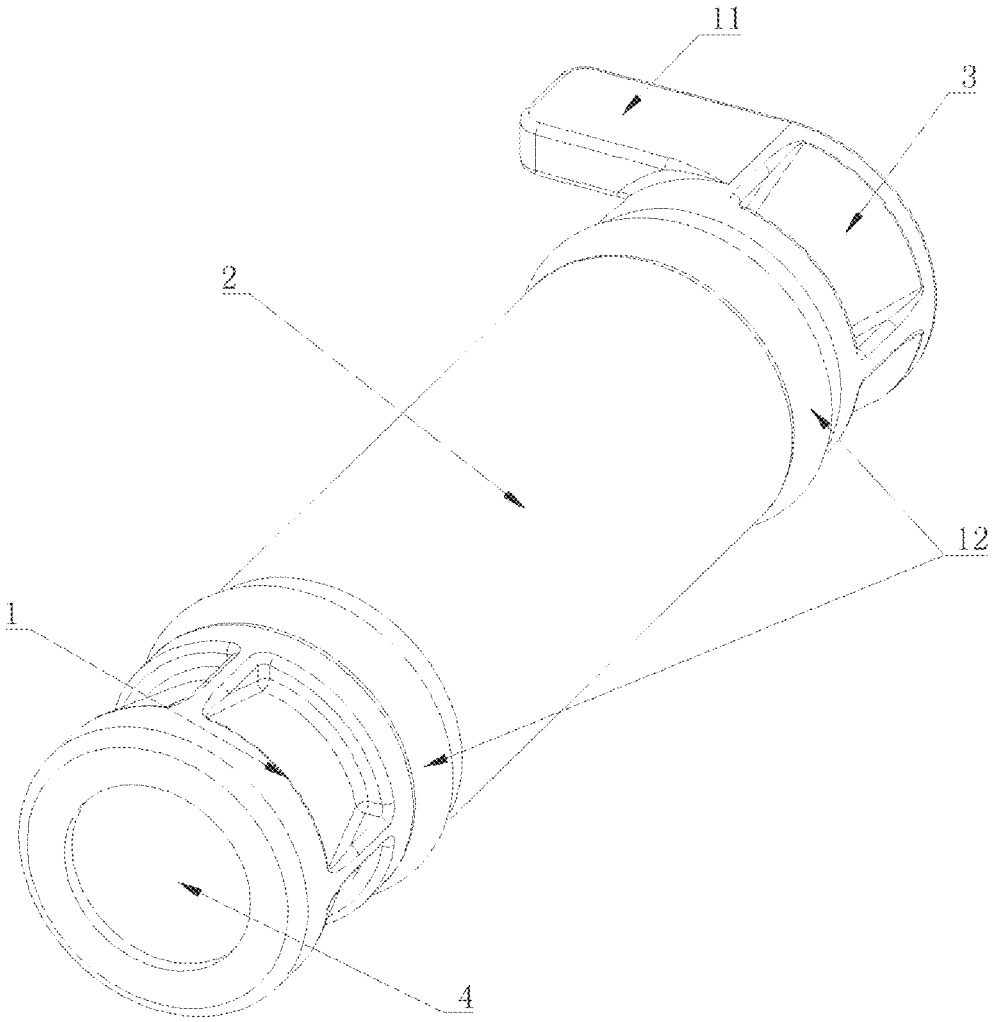
FIGS. 1-3 are schematic diagrams of an ejector at different viewing angles according to an embodiment of the present disclosure.
Figure 2:
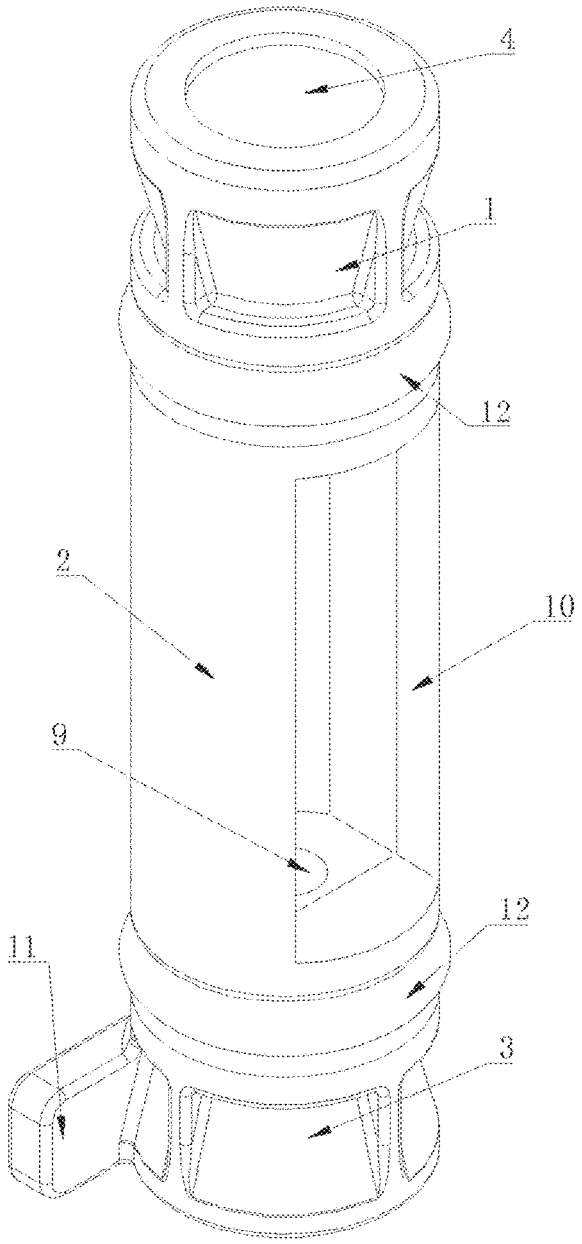
Figure 3:
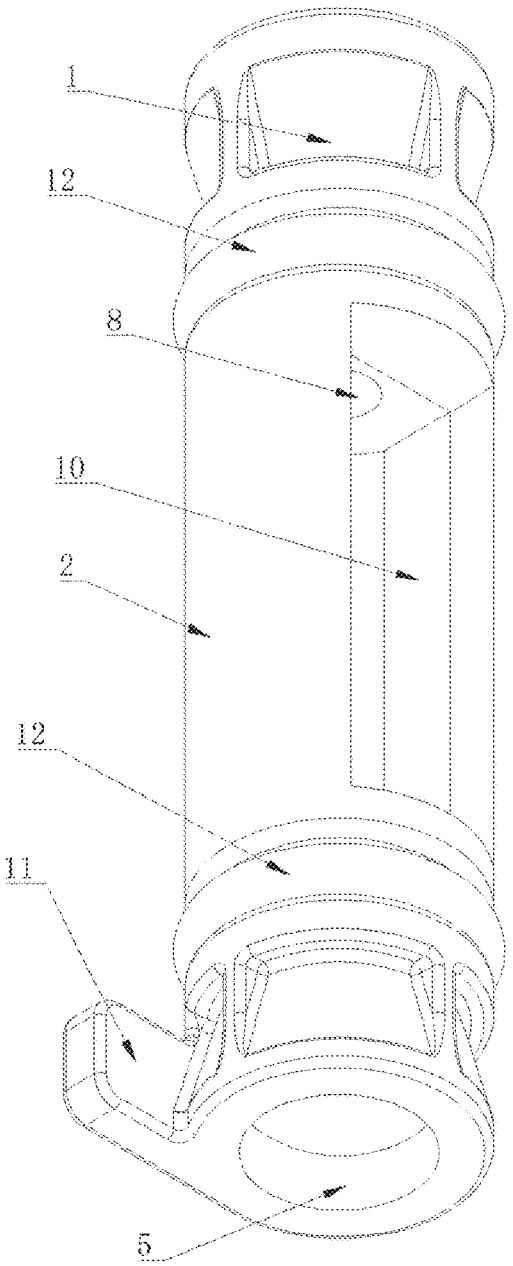
Figure 4:
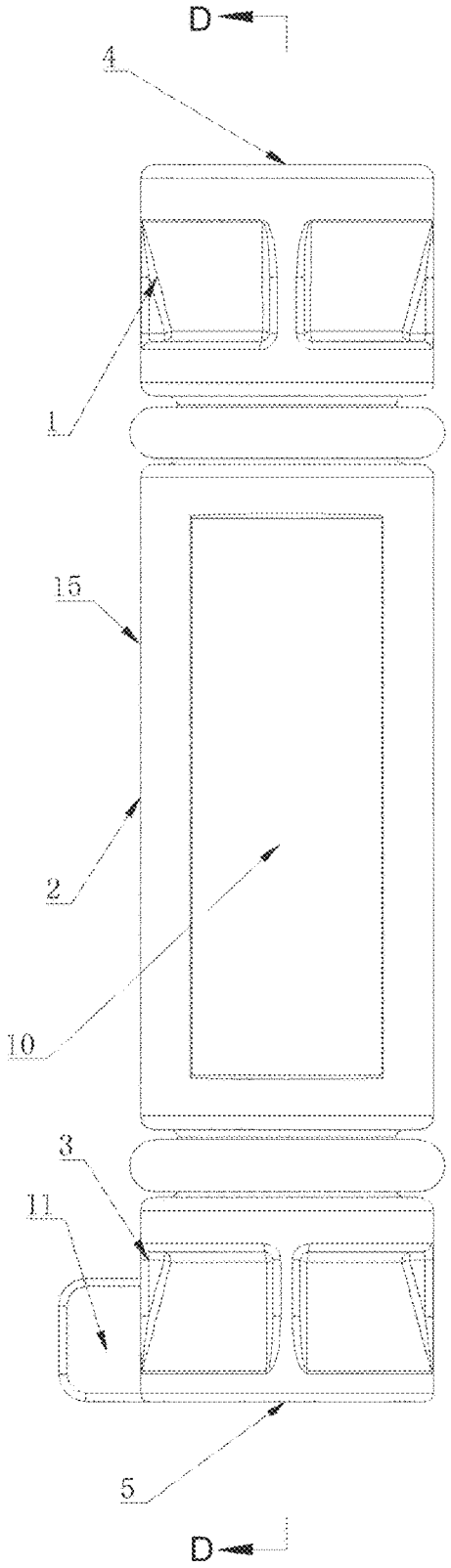
FIG. 4 is a schematic bottom view of an ejector according to an embodiment of the present disclosure.
Figure 5:
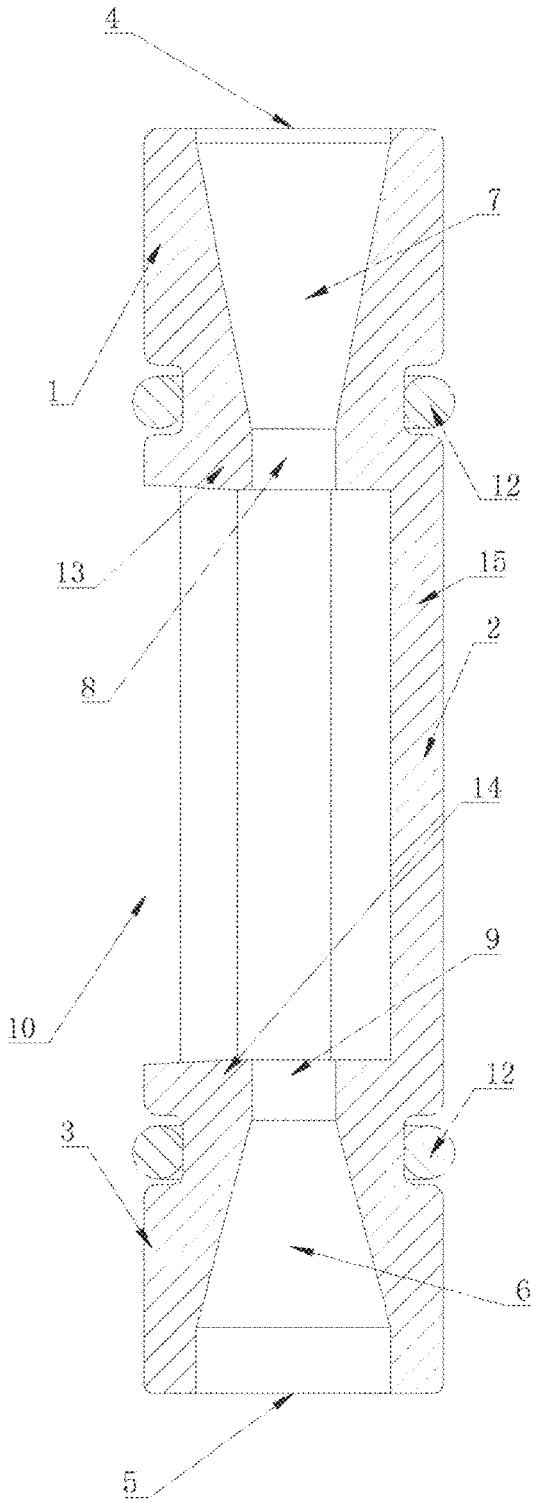
FIG. 5 is a schematic diagram of the section D-D in FIG. 4 according to an embodiment of the present disclosure.
Figure 6:
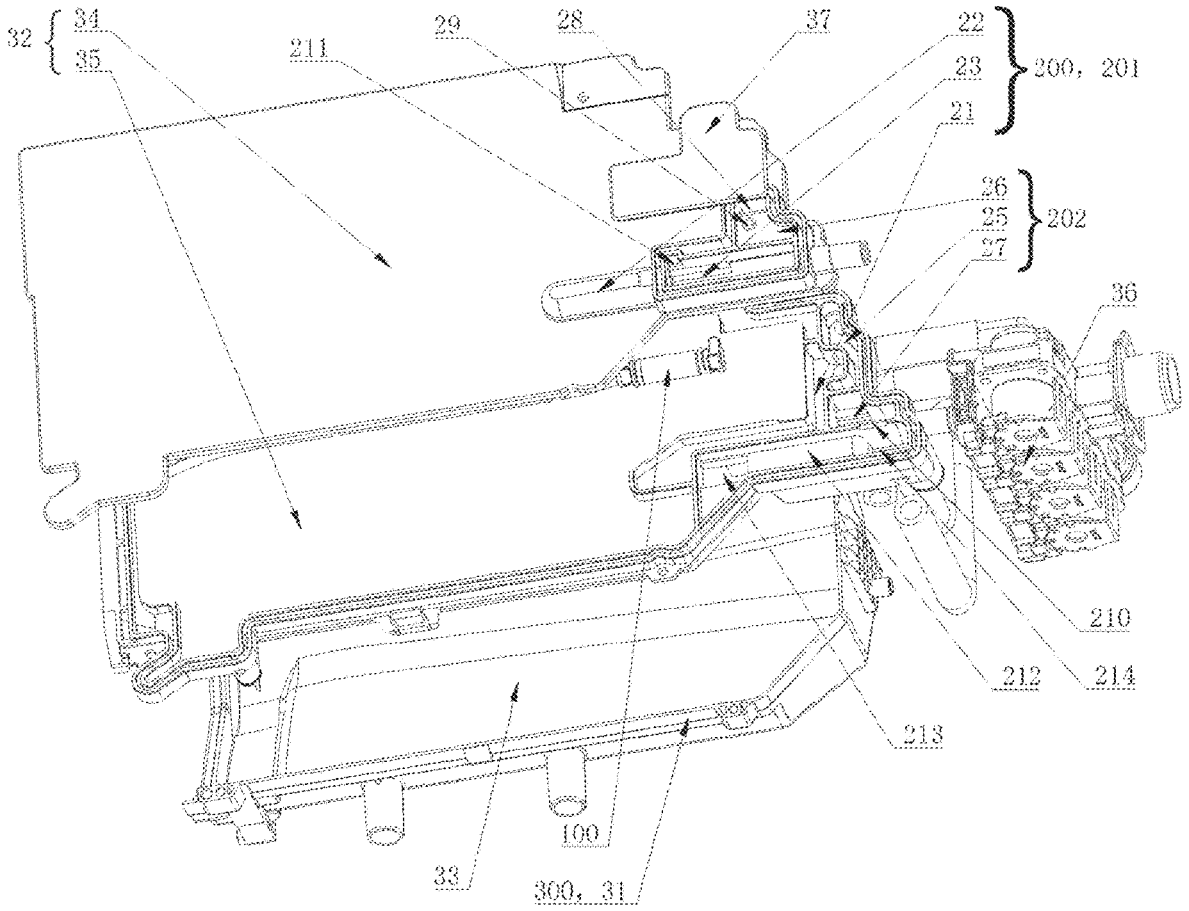
FIGS. 6-7 are schematic exploded views of a dispensing device according to an embodiment of the present disclosure.
Figure 7:
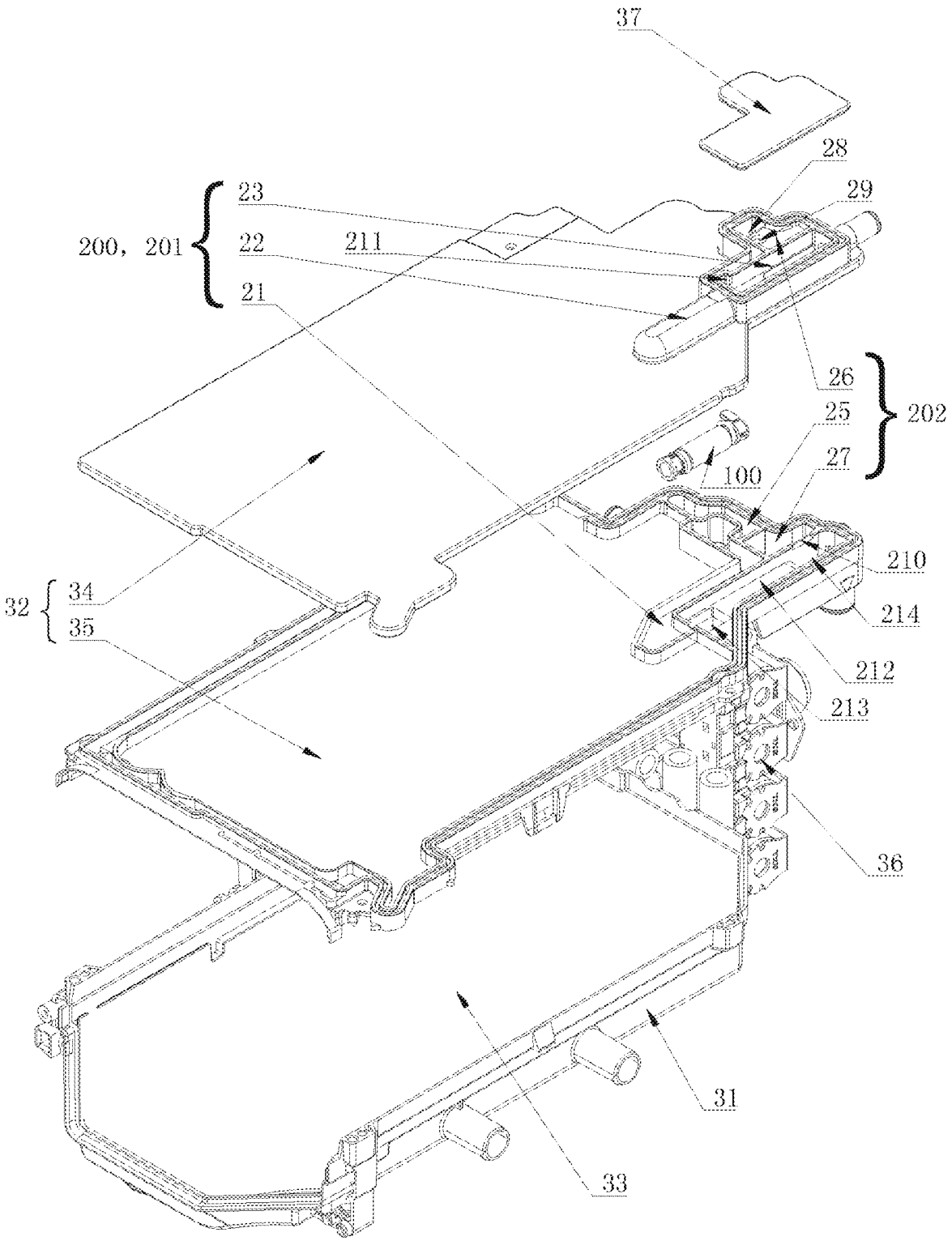
Figure 8:
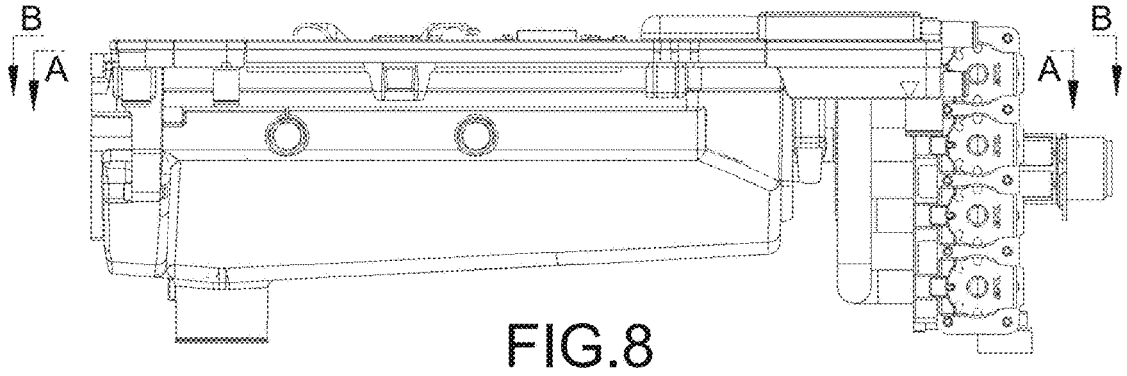
FIG. 8 is a schematic side view of a dispensing device according to an embodiment of the present disclosure.
Figure 9:
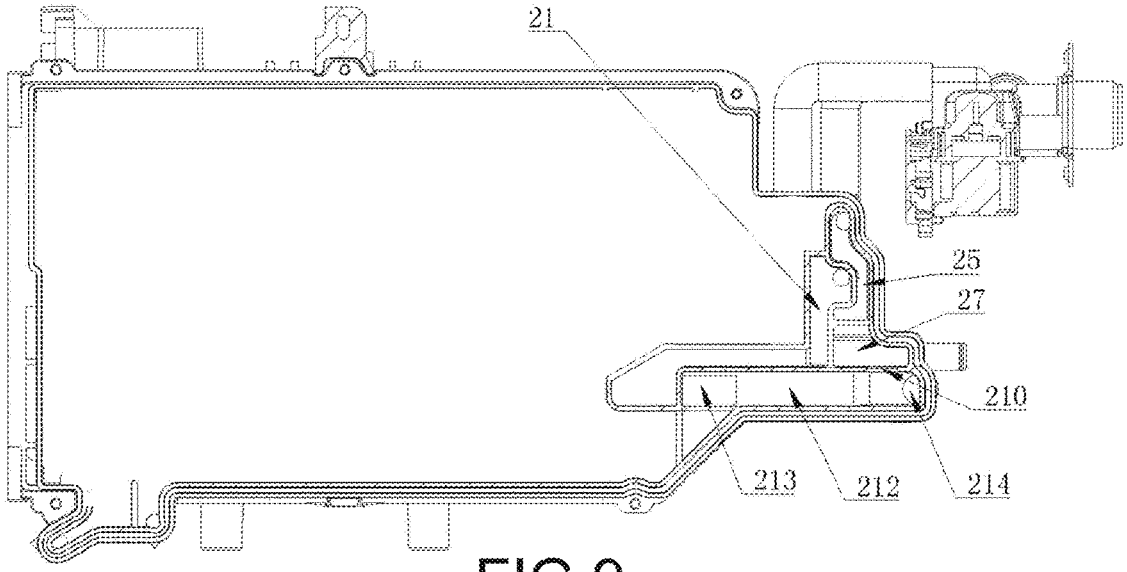
FIG. 9 is a schematic diagram of the section A-A in FIG. 8 according to an embodiment of the present disclosure.
Figure 10:
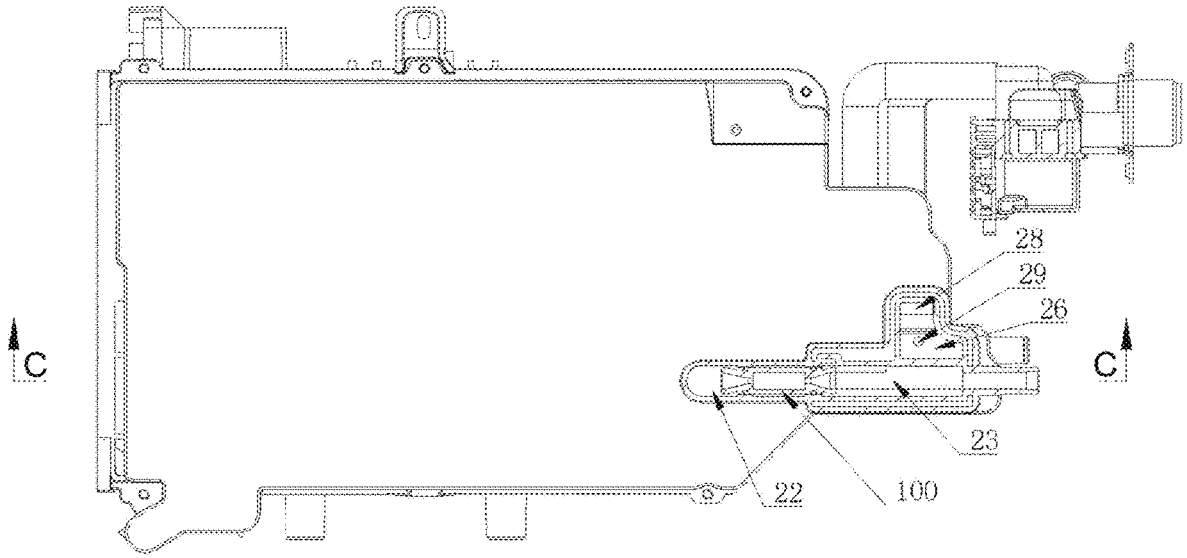
FIG. 10 is a schematic diagram of the section B-B in FIG. 8 according to an embodiment of the present disclosure.
Figure 11:
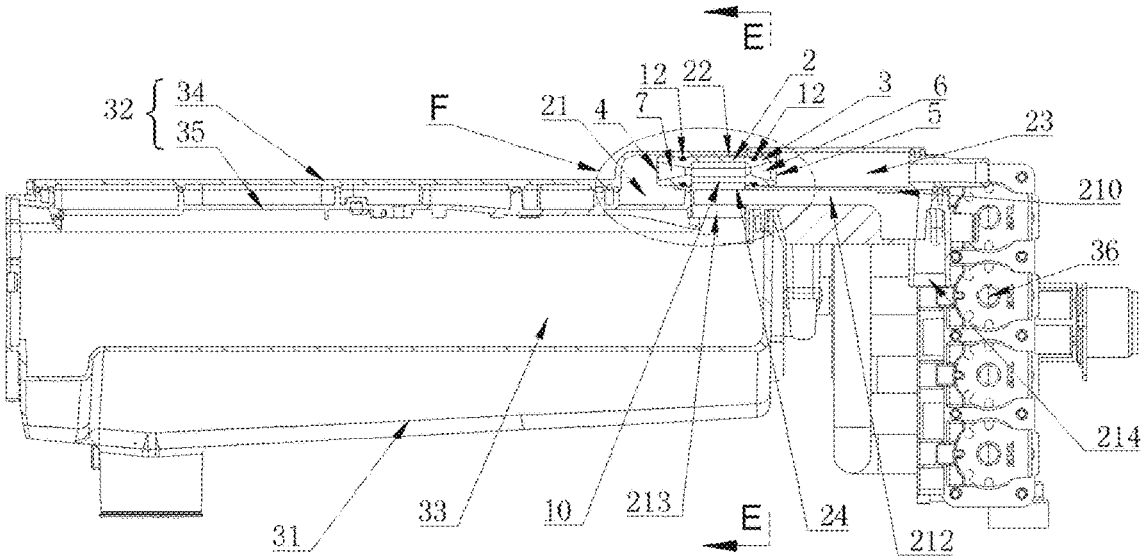
FIG. 11 is a schematic diagram of the section C-C in FIG. 10 according to an embodiment of the present disclosure.
Figure 12:
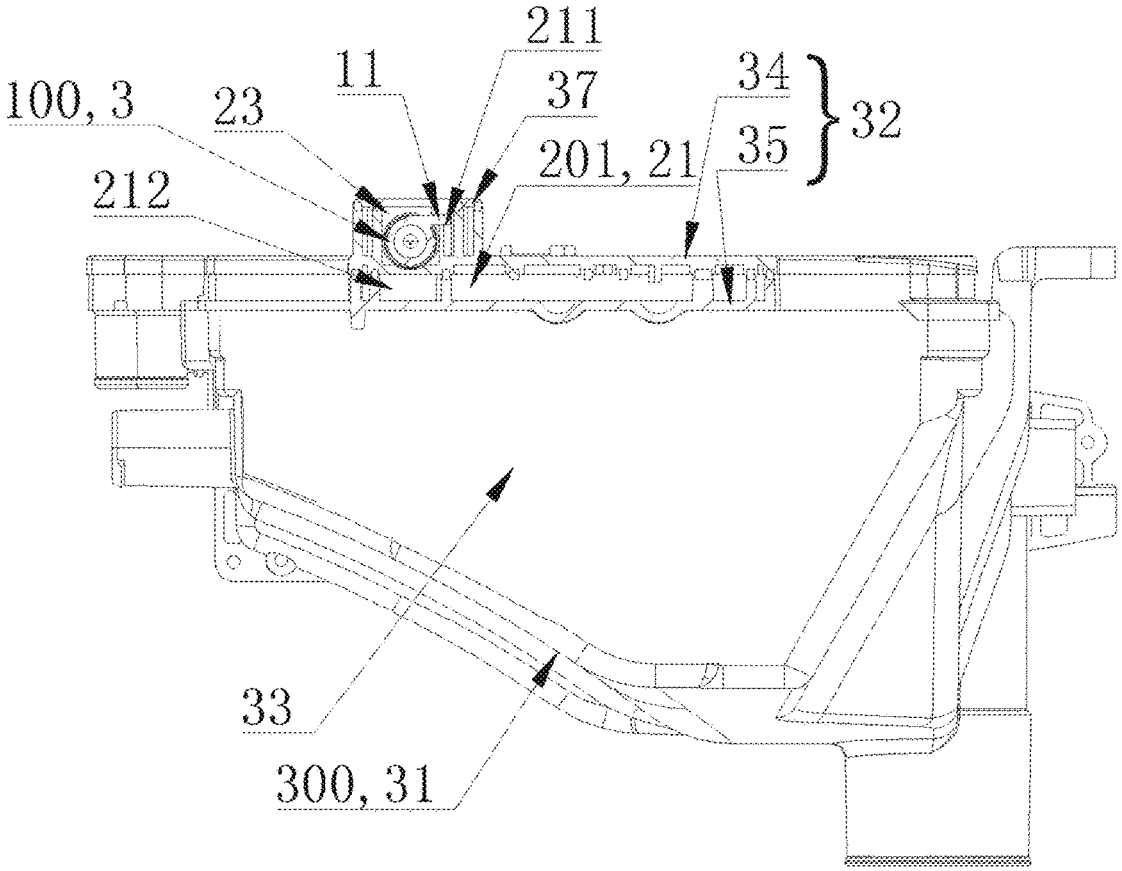
FIG. 12 is a schematic diagram of the section E-E in FIG. 11 according to an embodiment of the present disclosure.
Figure 13:
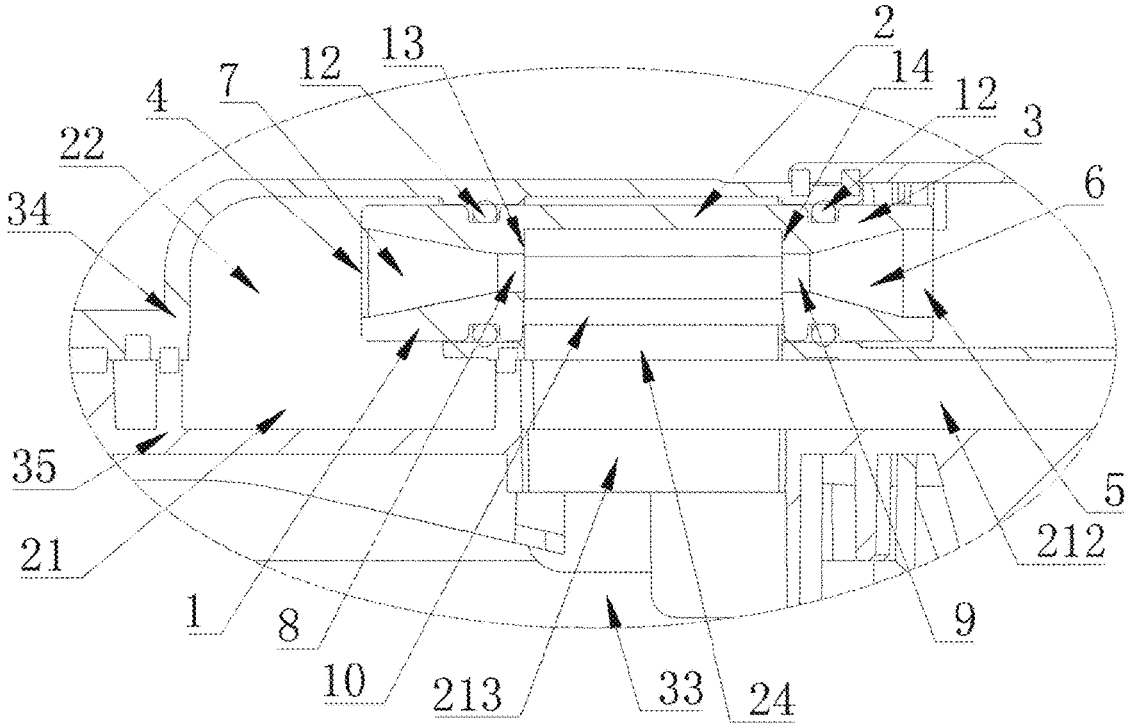
FIG. 13 is a schematic enlarged view of position F in FIG. 11 according to an embodiment of the present disclosure.

Description of main components: 100, ejector; 200, water supply waterway; 300, dispensing device; 1, front chamber portion; 2, connection portion; 3, rear chamber portion; 4, water inlet; 5, water outlet; 6, first conical flow channel; 7, second conical flow channel; 8, ejection hole; 9, injection hole; 10, gap; 11, mounting rib; 12, sealing ring; 13, front end wall; 14, rear end wall; 15, housing; 201, first water supply waterway; 202, second water supply waterway; 21, first water inlet chamber; 22, mounting chamber; 23, first water outlet chamber; 24, opening; 25, second water inlet chamber; 26, water passing chamber; 27, second water outlet chamber; 28, water passing inlet; 29, water passing outlet; 210, ventilation port; 211, positioning groove; 212, ventilation passage; 213, opening; 214, overflow port; 31, water box; 32, upper cover; 33, water inlet chamber; 34, upper cover plate; 35, lower cover plate; 36, water inlet valve; 37, cover plate; 1'-water inlet flow channel segment; 2'-straight flow channel segment; 3'-water outlet flow channel segment.

It needs to be noted that these drawings and written description are not intended to limit the scope of the inventive concept in any way, but rather to illustrate the inventive concept for those skilled in the art by reference to specific embodiments.

DETAILED DESCRIPTION

In order to make the objects, technical solutions and advantages of the embodiments of the present disclosure clearer, the ejector and the dispensing device in the embodiments will be described in detail in conjunction with the accompanying drawings in the embodiments of the present disclosure.

Embodiment 1

As shown in FIGS. 1 to 5, an ejector 100 is described in this embodiment. The ejector 100 is mainly used to supply water to laundry treatment appliance such as a washing machine or a drying machine, so that the inlet water flow can be pressurized by the ejector to obtain an inlet water flow with increased water pressure, and a the inlet water flow can be prevented from flowing backward, so the water flows mixed with additives are prevented from crossing each other.

In this embodiment, the ejector 100 for a laundry treatment appliance has a passage for allowing water flow to flow through formed by a front chamber portion 1, a connection portion 2 and a rear chamber portion 3 which are connected in sequence. In this embodiment, two ends of the front chamber portion 1 of the ejector are provided with a water inlet 4 of the ejector and an ejection hole 8 respectively, the water inlet 4 communicates with the upstream water channel, and the ejection hole 8 communicates with the connection portion 2. Two ends of the connection portion 2 respectively communicate with the ejection hole 8 of the front chamber portion 1 and an injection hole 9 of the rear chamber portion 3. The connection portion 2 is provided with a gap 10 enabling the passage in the ejector 100 to communicate with the outside atmosphere, and the gap 10 is configured to discharge water flowing backward from the rear chamber portion 3, so as to prevent water in the waterway equipped with the ejector from flowing back. Two ends of the rear chamber portion 3 are provided with the injection hole 9 and a water outlet 5 of the ejector 100, respectively. The injection hole 9 communicates with the connection portion 2 and is opposite to the ejection hole 8, so that water flowing into the connection portion 2 from the injection hole 9 can jump over the gap 10 formed in the connection portion 2 under the action of own water pressure and be directly injected into the ejection hole 8 formed in the rear chamber portion 3, so as to achieve the effects of smooth water inlet of the water flowing into the ejector 100 without interference from the gap.

In this embodiment, the rear chamber portion 3 has a variable-diameter flow channel with the cross-sectional dimension gradually increasing in the direction of water flow, and a small opening end of the variable-diameter flow channel directly communicates with the injection hole 9. The water inlet end of the rear chamber portion 3 is formed by a narrowed flow channel, so that it is reduced in the flow rate and pressure of the backflow water in the rear chamber portion 3, and further the backflow water is prevented from jumping over the gap 10 and flowing into the front chamber portion 1. Since the injection hole 9 of the rear chamber portion 3 communicates with the narrowed flow channel, the hole diameter of the place where the rear chamber portion 3 communicates with the gap 10 becomes smaller, so that the pressure of the water flow in the rear chamber portion 3 is not relieved, to maintain the pressure of the water flow in the rear chamber portion 3.

In this embodiment, the ejection hole 8 and the injection hole 9 of the ejector 100 are arranged coaxially, and water flowing out of the ejection hole 8 directly flows into the injection hole 9 through the flow channel formed by the connection portion 2, so that the water ejected from the ejection hole 8 can be directly injected into the injection hole 9 without interference, and the inlet water flow passes over the gap 10 and smoothly flows in.

In this embodiment, the connection portion of the ejector 100 is of a cylindrical structure, the front chamber portion 1 and the rear chamber portion 3 are respectively located at two ends of the connection portion 2 of the cylindrical structure, and the ejection hole 8 of the front chamber portion 1 and the injection hole 9 of the rear chamber portion 3 are coaxial with, or parallel to, the axis of the connection portion 2 of the cylindrical structure. Preferably, the injection hole 9 and the ejection hole 8 are arranged close to the axis of the cylindrical connection portion 2 to reduce the interference of the inlet water flow by the inner wall of the cylindrical connection portion 2.

In this embodiment, in order to ensure the water flow to pass over and to improve the pressure maintaining effect of the ejector 100, the following settings are made. A diameter of the cylindrical connection portion 2 is greater than the diameters of the injection hole 9 and the ejection hole 8. Preferably, the hole diameter of the cylindrical connection portion 2 is much greater than the diameters of the injection hole 9 and the ejection hole 8, Further preferably, the hole diameter of the cylindrical connection portion 2 is greater than twice the diameter of the injection hole 9 and greater than twice the diameter of the ejection hole 8, so that the water inlet end of the rear chamber portion is not open, but the variable-diameter flow channel communicates with the connection portion via the open, thereby achieving the effect of maintaining the pressure of the water flow in the rear chamber portion.

As shown in FIGS. 1-5, in this embodiment, the ejector 100 is a separate piece formed by a cylindrical housing 15, and the inside of the cylindrical housing 15 is hollow to define a flow channel of which the axis is extended in a straight line. The inside of the flow channel is provided with two partition ribs arranged at intervals, which are a front end wall 13 and a rear end wall 14 respectively and configured to divide the flow channel inside the housing 15 into three parts. A part of the housing 15 between the front end wall 13 and the rear end wall 14 forms the connection portion 2. Two ends of the flow channel of the housing 15 form the water inlet 4 and the water outlet 5 respectively, the flow channel part between the water inlet 4 and the front end wall 13 forms the front chamber portion 1, and the flow channel part between the water outlet 5 and the rear end wall 14 forms the rear chamber portion 3. The ejection hole 8 is formed in the front end wall 13, the injection hole 9 is formed in the rear end wall 14, and the injection hole 9 and the ejection hole 8 are coaxial and arranged close to the axial direction of the cylindrical housing 15. The middle of the side wall of the housing 15 is provided with a notch, which forms the gap 10 that enables the connection portion 2 to communicate with the outside atmosphere.

As shown in FIGS. 1 to 5, in this embodiment, the variable-diameter flow channel in the rear chamber portion 3 is a first conical flow channel 6 extending in an axis of the injection hole 9. The small mouth end of the first conical flow channel 6 is connected and coaxial with the injection hole 9, a diameter of the injection hole is same that of the small mouth end of the first conical flow channel 6. A large mouth end of the first conical flow channel 6 is connected with the water outlet 5 located on the side of the rear chamber portion 3 away from the connection portion, and the water outlet 5 is connected with a waterway located downstream of the ejector 100. The first conical flow channel 6 is coaxial with the injection hole 9. Preferably, the diameter of the large mouth end of the first conical flow channel 6 is greater than the diameter of the ejection hole 8 and smaller than or equal to the diameter of the connection portion 2 with a shape of cylinder.

In this embodiment, although the variable-diameter flow channel is described as being cone-shaped, the variable-diameter flow channel according to the present disclosure is not limited to the cone shape. The variable-diameter flow channel may be of a flow channel in which only one or more sides are bevels and the cross-sectional area is increased in the direction of the inlet water flow.

In this embodiment, the front chamber portion 1 is formed by a second conical flow channel 7 of which the cross-sectional area is gradually decreased in the direction of the water flow, and is configured to pressurize the water flowing out of the ejection hole 8, so that the water flowing out of the ejection hole 8 is pressurized to pass over the connection portion 2, and is avoided from flowing out from the gap 10 to affect the smoothness of water inlet. Preferably, the small mouth end of the second conical flow channel 7 communicates with and is coaxial with the ejection hole 8 of the front chamber portion 1, and a diameter of the small mouth end of the second conical flow channel is same with that of the ejection hole. The large mouth end of the second conical flow channel 7 is arranged on the side of the front chamber portion 1 away from the connection portion 2 and forms the water inlet 4 communicating with the waterway located upstream of the ejector 100, and the second conical flow channel 7 is coaxial with the ejection hole 8 of the front chamber portion 1.

Similarly, in this embodiment, the flow channel of the front chamber portion is set as the cone shape for pressurizing the water flowing out of flow channel. However, in the present disclosure, the flow channel provided in the front chamber portion is not limited to the cone shape, but may also be of a flow channel structure in which only one or more sides are bevels and the cross-sectional area decreases in the direction of the inlet water flow.

In this embodiment, one side of the connection portion 2 with a shape of cylinder is provided with a square notch extending in the axial direction, and the notch forms the gap 10 enabling the flow channel of the ejector to communicate with the outside atmosphere. Preferably, the connection portion 2 with a shape of cylinder is extended in a horizontal direction, and the notch formed on the side wall of the connection portion 2 faces downward. Further preferably, the axes of the injection hole 9 and the ejection hole 8 are eccentrically arranged slightly relative to the side of the notch away from the axis of the cylindrical connection portion 2, thereby allowing the backflow water to be discharged smoothly from the notch and further reducing the possibility of flowing back to the front chamber portion 1. In addition, the gap 10 arranged on one side of the connection portion 2 has a width in a radial direction of the connection portion 2 with a shape of cylinder that is smaller than a diameter of the connection portion 2, and a length in an axial direction of the connection portion 2 with a shape of cylinder that is smaller than or equal to the axial length of the connection portion 2.

In this embodiment, the cross-sectional area of the injection hole 9 is equal to, or approximately equal to, the cross-sectional area of the ejection hole 8, so that the water flow out of the ejection hole 8 can correspondingly fill the injection hole 9. During supplying water, it is ensured that the injection hole 9 is covered by the water flow, and clearance space on the injection hole in communication with the outside atmosphere is reduced, thereby maintaining the pressure of water flowing into the rear chamber portion 3. Preferably, the cross-sectional area of the injection hole 9 is slightly smaller than the cross-sectional area of the ejection hole 8, so that the water flowing to the ejection hole 8 can maximally flow into the injection hole 9, increasing the efficiency of supplying water.

Preferably, as shown in FIGS. 1 to 5, in this embodiment, the injection hole 9 and the ejection hole 8 of the ejector 100 are coaxial circular holes, and the diameter of the injection hole 9 is smaller than the diameter of the ejection hole 8 and greater than seven tenths of the diameter of the ejection hole 8. The injection hole 9 and the ejection hole 8 of the ejector 100 may also be holes with any cross-section, such as square, oval, polygonal, etc.

In this embodiment, the front chamber portion 1, the connection portion 2, and the rear chamber portion 3 of the ejector 100 are coaxial, and the flow channels arranged in the front chamber portion 1, the connection portion 2, and the rear chamber portion 3 communicate in sequence to form a passage allowing water flow to flow through, and the axis of the passage is extended in a straight line. Preferably, the front chamber portion 1, the connection portion 2, and the rear chamber portion 3 are integrally arranged to form an integral piece with a shape of cylinder, and two ends of the integral piece a shape of cylinder respectively form a water inlet 4 and a water outlet 5, and the side wall of the integral piece with a shape of cylinder is provided with a gap 10 formed by a notch.

Preferably, in this embodiment, the cylindrical outer wall of the ejector 100 is provided with at least one sealing ring 12 for sealing the gap between the outer wall of the ejector 100 and the inner wall of the waterway after the ejector 100 is mounted in the waterway, so that the water flow in the upstream waterway can only flow through the flow channel inside the ejector 100 to the downstream waterway. Further preferably, the upstream side and the downstream side of the gap 10 of the ejector 100 are each provided with at least one sealing ring 12, so that it is ensured that water flow in the waterway in which the ejector 100 is mounted does not escape from the gap 10.

Embodiment 2

As shown in FIGS. 1 to 13, a dispensing device 300 is described in this embodiment. The dispensing device includes a water supply waterway 200, an ejector 100 is mounted on the water supply waterway 200, and the ejector 100 is provided with a backflow-preventing gap 10 for enabling the water supply waterway 200 to communicate with the outside atmosphere. The ejector 100 is provided with a variable-diameter flow channel located downstream of the backflow-preventing gap 10 and with the cross-sectional area gradually increasing in the direction of water flow.

In this embodiment, the ejector 100 is mounted in the water supply waterway 200, a water inlet 4 and a water outlet 5 of the ejector 100 communicate with the upstream side and downstream side of the water supply waterway 200, respectively, so that the inlet water flow in the water supply waterway 200 needs to flow through the flow channel inside the ejector 100. The inlet water flow in the ejector 100 is subjected to the action of the variable-diameter flow channel located downstream of the gap 10, to maintain the pressure of the inlet water flow, so it is avoided pressure relief in the downstream of the gap 10 is occurred due to the arrangement of the gap in the water supply waterway. Thereby the water supply waterway 200 can provide high-pressure water flow while preventing from flowing back.

As shown in FIGS. 1 to 13, in this embodiment, the ejector 100 is a ejector 100 in Embodiment 1, and the gap 10 of the ejector 100 in Embodiment 1 constitutes the backflow-preventing gap 10. The ejector in this embodiment may also be any other structure of an ejector (not illustrated in the drawings) provided with a backflow-preventing gap and a variable-diameter flow channel downstream of the backflow-preventing gap.

As shown in FIGS. 6 to 11, in this embodiment, the water supply waterway 200 is provided with a mounting chamber 22, the ejector 100 is arranged in the mounting chamber 22, and an opening 24 is formed in the mounting chamber 22. The backflow-preventing gap 10 of the ejector 100 faces the opening 24, so that the flow channel inside the ejector 100 communicates with the outside atmosphere through the backflow-preventing gap 10 and the opening 24.

In the embodiment, in order to ensure the air-tightness of the water supply waterway 200, at the outer periphery of the ejector 100, the upstream and downstream sides of the backflow-preventing gap 10 are each provided with a sealing ring 12. The outer periphery of the sealing ring 12 is in sealing contact with the inner wall of the water supply waterway 200 so that water in the water supply waterway 200 is not leaked from the opening 24.

In addition, in order that water smoothly flows in the water supply waterway, the axis of the mounting chamber 22 is extended in a straight line, so that the water flowing out from the water outlet 5 of the ejector 100 continues to flow in a straight line. Thereby the pressure-maintaining effect of the water supply waterway 200 is improved and the water flows more smoothly.

In this embodiment, the dispensing device 300 includes a water box 31, and the inner space of the water box 31 defines a water inlet chamber 33 communicating with the outside atmosphere. The front end of the water box 31 is open, the top wall of the water box 31 is formed by an upper cover 32, and the water inlet chamber 33 communicates with the outside atmosphere through the opening at the front end of the water box 31. The water supply waterway 200 is integrally arranged on the upper cover 32 of the water box 31, and the backflow-preventing gap 10 of the ejector 100 faces downward and communicates with the water inlet chamber 33 of the water box 31, so that the water flowing backward from the backflow-preventing gap 10 falls directly into the water inlet chamber 33 of the water box 31 and flows out of the dispensing device 300 through a water outlet at the bottom of the water inlet chamber 33, and the backflow-preventing gap 10 can communicate with the outside atmosphere through the water inlet chamber 33.

In this embodiment, the water box 31 may be internally provided with a drawer component which can be drawn outward from the front opening and arranged in the water inlet chamber 33, and the drawer portion is internally provided with one or more dispensing chambers for containing different kinds of additives. Other waterways may be integrally arranged on the upper cover 32 of the water box 31, and the additives in the dispensing chambers may be correspondingly dispensed by the waterways, so that different additives may be dispensed by the dispensing device (not shown in the figures).

In this embodiment, the upper cover 32 of the water box 31 is formed by correspondingly connecting a lower cover plate 35 and an upper cover plate 34. The periphery of the upper cover plate 34 is hermetically connected with the periphery of the lower cover plate 35 to form a hollow portion inside, and a plurality of blocking ribs are arranged in the hollow portion so that the hollow portion is divided into a plurality of different waterways. The upper cover 32 in this embodiment may also be set as an integral piece and internally provided with the required waterways.

As shown in FIGS. 6 to 13, in this embodiment, the upper cover plate 34 of the upper cover 32 of the water box 31 is provided with the mounting chamber 22 upward protruding and a first water outlet chamber 23, and the mounting chamber 22 communicate with the first water outlet chamber 23. The bottom of the end of the mounting chamber 22 away from the first water outlet chamber 23 is provided with the opening 24, the opening 24 enables the mounting chamber 22 formed at the upper side of the upper cover plate 34 to communicate with the first water inlet chamber 21 formed below the upper cover plate 34 and located between the upper cover plate 34 and the lower cover plate 35. The top of one end of the first water inlet chamber 21 communicates with the mounting chamber 22 through the opening 24, and the bottom of the other end of the first water inlet chamber 21 is connected to an external pipe and a water inlet valve 36 through a connector to form the water supply waterway 200, i.e., the first water supply waterway 201. The ejector 100 is mounted in the water supply waterway 200.

In this embodiment, a sealing structure is arranged between the ejector 100 and the inner wall of the water supply waterway 200 to separate the opening 24 from the water supply waterway 200 on the upstream side and downstream side of the ejector 100, so as to avoid that water in the water supply waterway directly flows out from the opening and into the gap to affect the water flow in the flow channel of the ejector.

In this embodiment, the housing 15 of the ejector 100 at the upstream side and downstream side of the backflow-preventing gap 10 are each provided with at least one ring of sealing structure radially outwardly protruding, respectively, so the first water inlet chamber 21 and the first water outlet chamber 23 are separated from the opening 24. In this embodiment, the sealing structure may be any structure with fluid sealing function in the prior art, such as a sealing ring and a sealing gasket. Preferably, in this embodiment, the sealing structure employs a sealing ring 12 sleeving the outer wall of the housing 15 of the ejector 100. The sealing ring 12 is made of material which is elastically deformable, such as rubber. The periphery of the sealing ring 122 is in sealing contact with the inner wall of the water supply waterway 200 to separate the upstream waterway from the downstream waterway, further to form the sealing structure.

Preferably, in this embodiment, the housing 15 of the ejector 100 is provided with mounting grooves being inwardly recessed, and the sealing rings 12 are arranged in the mounting grooves in one-to-one correspondence for positioning the sealing rings 12 in the axial direction.

In this embodiment, the sealing ring 12 on the upstream side of the backflow-preventing gap 10 on the ejector 100 with a shape of cylinder is arranged downstream of the strip-shaped mounting chamber 22 communicating with the first water inlet chamber 21. And the sealing ring 12 on the downstream side of the backflow-preventing gap 10 on the cylindrical ejector 100 is arranged upstream of the strip-shaped mounting chamber 22 communicating with the first water outlet chamber 23.

In this embodiment, the first water inlet chamber 21 is arranged below the strip-shaped mounting chamber 22, and the bottom wall of the water inlet end of the mounting chamber 22 is provided with a through hole communicating with the first water inlet chamber 21 below. At least a portion of the ejector 100 with a shape of cylinder is arranged above the through hole, and the end of the ejector 100 arranged above the through hole is a water inlet 4. The water inlet 4 is spaced from the inner wall surface of the strip-shaped mounting chamber 22 to ensure to smoothly flow water in the ejector 100.

In this embodiment, the mounting chamber 22 and the first water outlet chamber 23 are coaxially arranged so that the axes of the flow channels formed by the mounting chamber 22 and the first water outlet chamber 23 are in a straight line, thereby allowing water flow to flow smoothly.

In this embodiment, the ejector 100 is coaxially inserted into the mounting chamber 22, the front chamber portion 1 and the connection portion 2 of the ejector 100 are correspondingly inserted into the first water inlet chamber 21, and the sealing ring 12 arranged at the junction of the front chamber portion 1 and the connection portion 2 of the ejector 100 is in sealing contact with the inner wall of the mounting chamber 22, so that the upstream portion and the downstream portion of the mounting chamber 22 are separated, and the water flow flowing into the mounting chamber 22 from the first water inlet chamber 21 can only flow into the flow channel inside the ejector 100. The bottom of the side of the mounting chamber 22 close to the first water outlet chamber 23 is provided with an opening 24, and the opening 24 is located on the downstream side of the sealing ring 12 arranged at the junction of the front chamber portion 1 and the connection portion 2 of the ejector 100. The opening communicates with a ventilation passage 212 arranged between the upper cover plate 34 and the lower cover plate 35. The ventilation passage 212 is provided with an opening 213 extending through the lower cover plate 35. The opening 213 enables the ventilation passage 212 to communicate with the atmosphere through the water inlet chamber 33 of the water box 31. The gap 10 for preventing from flowing back in the connection portion 2 of the ejector 100 faces the opening 24, and the opening 213 is formed below the opening 24, so that the ejector 100 can directly communicate with the water inlet chamber 33 of the water box 31 through the gap 10 for preventing from flowing back, the opening 24, and the opening 213. The sealing ring 12 arranged at the junction of the rear chamber portion 3 of the ejector 100 and the connection portion 2 is located in the mounting chamber 22 downstream of the opening 24, and is in sealing contact with the inner wall of the mounting chamber 22, so that the mounting chamber 22 is separated from the first water outlet chamber 23. So the first water outlet chamber 23 does not communicate directly with the atmosphere through the gap 10, and the waterway downstream of the ejector is separated from the gap 10 for preventing from flowing back, thereby maintaining the pressure.

The upstream side and downstream side of the gap 10 of the ejector 100 are each provided with a sealing ring 12 sleeving on the outer circumference. The ejector 100 is supported and mounted in the water inlet chamber 33 by the two sealing rings 12. The front and rear ends of the ejector 100 is supported in the axial direction respectively, so that the ejector 100 can be stably mounted in the water supply waterway 200.

In this embodiment, the top of the first water outlet chamber 23 is provided with a detachable cover plate 37, so that the ejector 100 can be subjected to operations such as mounting and replacing after the cover plate 37 is detached. In order to keep the air-tightness of the water supply waterway 200, a ring of sealing structure is arranged at the junction of the cover plate 37 and the upper cover 32 to ensure that there is a gap between the cover plate 37 and the upper cover 32 of the water inlet chamber 33.

As shown in FIGS. 1 to 13, in this embodiment, the peripheral wall of the ejector 100 is provided with a mounting rib 11 protruding outwardly, and the mounting rib 11 is arranged on the upper cover 32 of the water box 31 to avoid the rotation of the ejector 100 in axial direction after the ejector 100 is mounted in the mounting chamber 22. The mounting rib 11 is located between the cover plate 37 and the upper cover plate 34 of the upper cover 32 to circumferentially limit the ejector 100 in two different directions, thus the ejector 100 is effectively prevented from circumferentially rotating after being mounted. Preferably, the mounting rib 11 is arranged at the rear chamber portion 3 of the ejector 100, the mounting rib 11 does not interfere to assembly the ejector when the ejector 100 is inserted into the mounting chamber 22 from the first water outlet chamber 23. Further preferably, the protruding length of the mounting rib 11 is greater than the difference between the radial dimension of the mounting chamber 22 and the radial dimension of the periphery of the ejector 100 with a shape of cylinder, so that the mounting rib can be as a limiting structure. The ejector 100 can abut against the end of the first water outlet chamber 23 for limiting, when the ejector 100 is inserted into the mounting chamber 22 from the first water outlet chamber 23, thereby ensuring that the ejector is mounted in place.

Preferably, as shown in FIGS. 1-11, in this embodiment, one side of the first water outlet chamber 23 is provided with a positioning groove 211 radially extending and downwardly recessed, and the positioning groove is located at the junction of the first water outlet chamber 23 and the mounting chamber 22 for axially fixing the mounting rib 11 after the ejector 100 is mounted. The mounting rib 11 protruding from the periphery of the rear chamber portion 3 of the ejector 100 is inserted into the positioning groove 211 when the ejector is mounted in the mounting chamber 22, and the mounting rib 11 is limited by the positioning groove 211, so that the ejector 100 is fixed in the axial direction after being mounted.

In this embodiment, the top of the upper cover 32 is provided with a positioning groove 211 communicating with the first water outlet chamber 23 and arranged at one side of the first water outlet chamber 23, and the positioning groove 211 is arranged at the junction of the first water outlet chamber 23 and the mounting chamber 22. The mounting rib 11 of the ejector 100 is correspondingly inserted into the positioning groove 211. In this embodiment, the mounting rib 11 is extended in the tangential direction of the outer peripheral wall of the ejector 100 with a shape of cylinder, and the distance between the end of the mounting rib 11 and the center of the ejector 100 with a shape of cylinder is greater than the radial dimension of the mounting chamber 22, so that at least part of the mounting rib 11 can be correspondingly inserted into the positioning groove. The ejector is axially limited in axial direction. By the above arrangement, after the ejector 100 is inserted into the mounting chamber 22 from the first water outlet chamber 23, the ejector 100 is rotated about the axis to make the mounting rib 11 be correspondingly inserted into the positioning groove 211 from the upper opening, and then the cover 37 is snapped, thereby the ejector 100 is fixedly mounted on the dispensing device 300.

Further, in order to fix the ejector 100 in the axial direction after being mounted, other positioning structures may be arranged on the upper cover plate 34 to limit the movement of the mounting rib 11 in the axial direction of the ejector 100. The positioning structure may be any structure known in the art, for example: two ribs upward protruding are formed on the upper cover plate 34, the two ribs is in limiting contact with two opposite sides of the mounting rib 11 in the axial direction of the ejector 100 to fix the ejector 100 in the axial direction. Alternatively, the mounting rib 11 is provided with a positioning projection corresponding to the positioning groove arranged on the upper cover plate 34, and the positioning projection is correspondingly inserted into the positioning groove after the mounting rib 11 is overlapped on the upper cover plate 34, so that the ejector 100 may also be fixed in the axial direction (not shown in the figures).

Embodiment 3

As shown in FIGS. 1 to 13, a laundry treatment appliance is described in this embodiment. The laundry treatment appliance includes a first water supply waterway 201 for providing high-pressure inlet water flow; a second water supply waterway 202 for providing non-high pressure inlet water flow; and the ejector 100 in Embodiment 1 which is mounted in the first water supply waterway 201 to prevent backflow of the water supply waterway and maintain the pressure of the outlet water flow.

In this embodiment, the laundry treatment appliance may be any known appliance capable of treating laundry, such as having any one or a combination of functions of washing, drying, ironing, and the like. In this embodiment, taking a laundry treatment appliance having a drying function as an example, the first water supply waterway communicates with a washing structure arranged on the laundry treatment appliance. The washing structure is used for flushing lint on a lint filter. The lint filter may be a structure for filtering lint during performing drying by the laundry treatment appliance, and may be any one of other existing lint filtering structures applied to the laundry treatment appliance. The second water supply waterway communicates with a condenser arranged on the laundry treatment appliance for supplying water flow for heat exchange to the condenser. The condenser may be a condenser for condensing and exchanging the air flow in the air duct during performing drying by the laundry treatment appliance, or any other existing condenser applied to the laundry treatment appliance.

In this embodiment, the first water supply waterway 201 and the second water supply waterway 202 are integrally arranged on a dispensing device 300 of the laundry treatment appliance, the dispensing device 300 is described in Embodiment 2, and the first water supply waterway 201 is the water supply waterway 200 described in Embodiment 2.

In this embodiment, the second water supply waterway 202 is arranged on an upper cover 32 of the dispensing device 300, the second water supply waterway 202 is provided with a ventilation port 210, and the ventilation port 210 communicates with a gap 10 of the ejector 100 mounted in the first water supply waterway 201 and communicates with the atmosphere through the same ventilation passage 212, so that different water supply waterways in the dispensing device 300 share the same ventilation passage 212. Thereby the structure of the dispensing device is simplified.

In this embodiment, the dispensing device 300 is further provided with the ventilation passage 212, and the two ends of the ventilation passage 212 communicate with the ventilation port 210 of the second water supply waterway 202 and the outside atmosphere respectively, and the gap 10 for preventing from flowing back of the ejector 100 communicates with the ventilation passage 212 through an opening 24 formed in an upper cover plate 34.

In this embodiment, the ventilation passage 212, the first water supply waterway 201 and the second water supply waterway 202 are all integrally formed on the upper cover 32 of a water box 31, and one end of the ventilation passage 212 communicates with a water inlet chamber 33 formed by the water box 31, and the other end of the ventilation passage 212 communicates with the ventilation port 210 of the second water supply waterway 202.

In this embodiment, the second water supply waterway 202 includes a second water inlet chamber 25, a water passing chamber 26 and a second water outlet chamber 27 that communicate in sequence.

The second water inlet chamber 25 is arranged on the upper cover 32 of the water box 31 and located between the upper cover plate 34 and a lower cover plate 35 of the upper cover 32, and the bottom of the second water inlet chamber 25 communicates with a second water inlet pipeline and a water inlet valve 36 through a connector.

The upper part of the second water inlet chamber 25 is provided with the water passing chamber 26, the water passing chamber 26 is protruded above the upper cover plate 34, and the water passing chamber 26 is provided with a water passing inlet 28 and a water passing outlet 29. The water passing inlet 28 and the water passing outlet 29 are arranged at the bottom wall of the water passing chamber 26 in a staggered manner and are both penetrated through the upper cover plate 34. The water passing chamber 26 is communicated with the top of the second water inlet chamber 25 by water passing inlet 28.

The second water outlet chamber 27 is arranged below the water passing chamber 26, and located between the upper cover plate 34 and the lower cover plate 35. The water passing chamber 26 is communicated with the top of the second water outlet chamber 27 by the water passing outlet 29. The bottom of the second water outlet chamber 27 is provided with a second water outlet from which the water flows out of the dispensing device 300, and the second water outlet communicates with a water inlet pipe of the condenser of the laundry treatment appliance via a pipeline, to provide water to the condenser of the laundry treatment appliance for heat exchange.

In this embodiment, the upper of the second water outlet chamber 27 of the second water supply waterway 202 is provided with a ventilation port 210, and the ventilation port 210 is a notch formed at the top of a rib formed on the lower cover plate 35 and being as the side wall of the second water outlet chamber 27, and the notch is used for communicating the second water outlet chamber 27 on two sides of the rib with the ventilation passage 212. The ventilation passage 212 is horizontally extended and is integrally formed on the upper cover 32 of the water box 31. The ventilation port 210 communicates with one end of the ventilation passage 212. The other end of the ventilation passage 212 is provided with an opening 213 communicating with the water inlet chamber 33 below. The opening 213 is penetrated through the lower cover plate 35 of the upper cover 32.

In this embodiment, the ejector 100 in the first water supply waterway 201 is located above the opening 213 of the ventilation passage 212, and the gap 10, for preventing from flowing back, on the ejector 100 faces downward and is aligned to the opening 213 below, so that the gap 10, for preventing from flowing back, of the ejector 100 can directly communicate with the water inlet chamber 33 of the water box 31 through the opening 213.

In this embodiment, the ventilation passage 212 is further provided with an overflow port 214, the overflow port 214 is located close to the ventilation port 210 and is located farther from the opening 213 with respect to the ventilation port 210, and the overflow port 214 communicates with a drain pipe of the laundry treatment appliance for discharging overflow water flow of the laundry treatment appliance. Preferably, in order to smoothly discharge the overflow water flow, the overflow port 214 is arranged at the lowermost of the ventilation passage 212, and the overflow water flow flowing into the ventilation passage 212 can be completely discharged through the overflow port 214. Thereby the dispensing device 300 does not overflow.

Embodiment 4

A dispensing device is described in this embodiment. The dispensing device in this embodiment differs from the dispensing device in Embodiment 3 in that, the ejector is not a separate component, but as a part of the upper cover of the dispensing device integrated on the water supply waterway.

Figure 14:
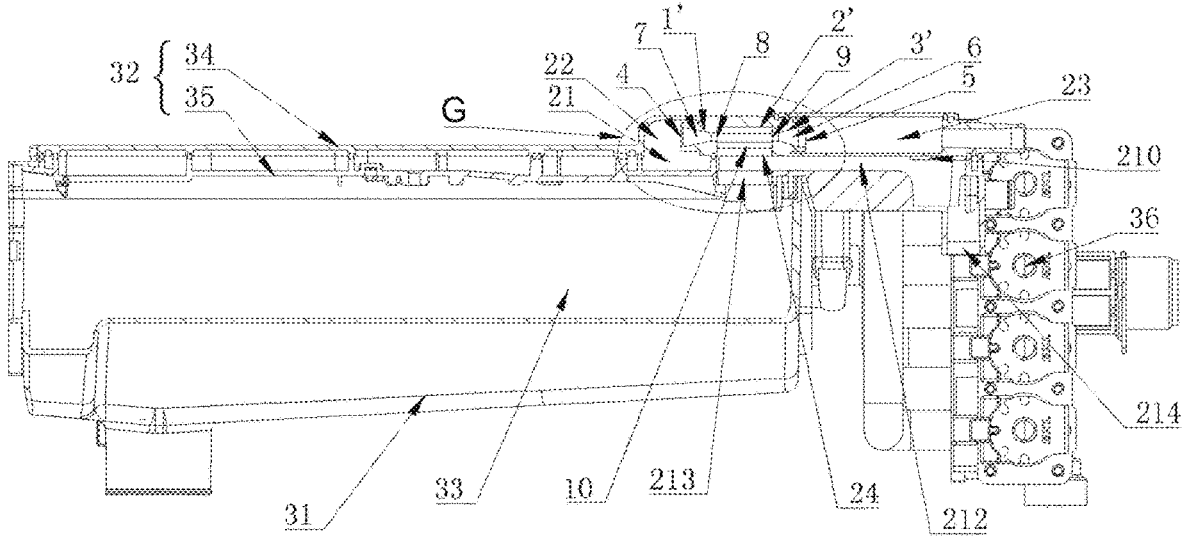
FIG. 14 is a schematic cross-sectional view of a dispensing device according to another embodiment of the present disclosure.
Figure 15:
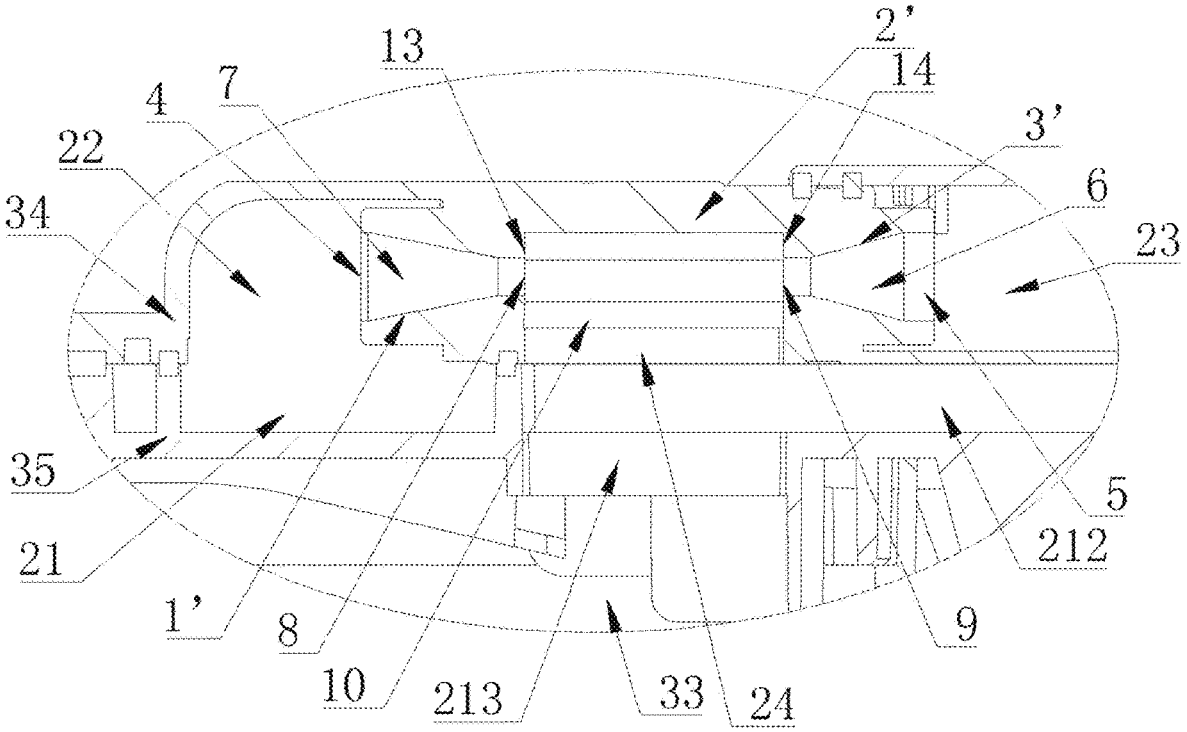
FIG. 15 is a schematic enlarged view of position G in FIG. 14 according to another embodiment of the present disclosure.

As shown in FIGS. 14 and 15, in this embodiment, the dispensing device includes a water supply waterway 200. The water supply waterway 200 is provided with a gap 10 for preventing from flowing back communicating with the outside atmosphere. The water supply waterway 200 is provided with an ejection hole 8 on the upstream side of the gap 10 for preventing from flowing back, and an injection hole 9 on the downstream side of the gap 10 for preventing from flowing back. A center line of the ejection hole 8 is coaxial with a center line of the injection hole 9, and the diameter of the ejection hole 8 is approximately equal to the diameter of the injection hole 9.

In this embodiment, the water supply waterway 200 comprises a straight flow channel segment 2' of which an axis is extended in a straight line, and the side wall of the straight flow channel segment 2' is provided with a notch. The water supply waterway 200 is communicated with the outside atmosphere by notch being as a gap 10 for preventing from flowing back.

In this embodiment, the water supply waterway 200 is internally provided with a front end wall 13 located upstream of the gap 10 and a rear end wall 14 located downstream of the gap 10, the ejection hole 8 is formed on the front end wall 13, and the injection hole 9 is formed on the rear end wall 14. Preferably, both the front end wall 13 and the rear end wall 14 are perpendicular to the axis of the straight flow channel segment 2'.

In this embodiment, the axis of the straight flow channel segment 2' coincides with, or is parallel to, the axes of the ejection hole 8 and the injection hole 9. Preferably, the centers of the ejection hole 8 and the injection hole 9 are arranged substantially at the central axis of the straight flow channel segment 2', and the diameter of the injection hole 9 is slightly smaller than the diameter of the ejection hole 8. Preferably, the difference between the diameters of the injection hole 9 and the ejection hole 8 is smaller than or equal to one fifth of the diameter of the injection hole 9. Further preferably, the difference between the diameters of the injection hole 9 and the ejection hole 8 is smaller than or equal to one tenth of the hole diameter of the injection hole 9 (similarly, the relationship between the dimensions of the injection hole and the ejection hole of the dispensing device in Embodiment 2 satisfies the above condition).

In this embodiment, the water supply waterway 200 further comprises a water inlet flow channel segment 1' arranged on the upstream side of the front end wall 13, and the water inlet flow channel segment 1' coaxially communicates with the ejection hole 8. The water inlet flow channel segment 1' is a flow channel with the cross-sectional area gradually decreasing in the direction from the water inlet 4 to the ejection hole 8. Preferably, a first flow channel segment with invariable diameter is arranged between the small mouth end of the water inlet flow channel segment 1' and the end face of the ejection hole 8, and the large mouth end of the water inlet flow channel segment 1' is connected with a second flow channel segment with invariably diameter.

In this embodiment, the water supply waterway 200 further comprises a water outlet flow channel segment 3' arranged on the downstream side of the rear end wall 14, and the water outlet flow channel segment 3' coaxially communicates with the injection hole 9. The water outlet flow channel segment 3' is a flow channel with the cross-sectional dimension gradually increasing in the direction of the inlet water flow. The small mouth end of the water outlet flow channel segment 3' communicates with the injection hole 9 and the large mouth end of the water outlet flow channel segment 3' communicates with a downstream waterway Preferably, a flow channel segment with invariable diameter and/or a narrowed flow channel segment narrowed in the direction of the water flow is arranged between the small mouth end of the water outlet flow channel segment 3' and the end face of the injection hole 9.

In this embodiment, the water supply waterway 200 comprises a water inlet chamber and a water outlet chamber in different levels. The water inlet chamber communicates with the gap 10 through the ejection hole 8, and the water outlet chamber communicates with the gap 10 through the injection hole 9, for injecting the water flow in the water inlet chamber into the water outlet chamber to form a waterway for flowing water.

In this embodiment, the mounting chamber 22 is strip-shaped, and the middle of the strip-shaped mounting chamber 22 has the straight flow channel segment 2' of which the side wall is provided with a notch to form the gap 10 for preventing from flowing back. The front end wall 13 with the ejection hole 8 and the rear end wall 14 with the injection hole 9 are arranged at the two ends of the straight flow channel segment 2'. The mounting chamber 22 on the upstream side of the front end wall 13 forms the water inlet flow channel segment 1', and the mounting chamber 22 on the downstream side of the rear end wall 13 forms the water outlet flow channel segment 3'.

In this embodiment, the dispensing device includes a water box 31, the top wall of the water box 31 is formed by the upper cover 32, and the water supply waterway 200 is integrally arranged on the upper cover 32. The upper cover 32 is formed by correspondingly connecting the upper cover plate 34 with the lower cover plate 35 in a snap-fit manner. The water outlet chamber and the mounting chamber 22 are upward protruded from the upper cover plate 34, the mounting chamber 22 is open at one end to communicate with the water outlet chamber, and the injection hole 9 is arranged between the open end of the mounting chamber 22 and the gap for preventing from flowing back. The water inlet chamber is arranged between the upper cover plate 34 and the lower cover plate 35. The other end of the mounting chamber 22 is closed, the bottom of the mounting chamber 22 is provided with a through hole communicating with the water inlet chamber below, and the ejection hole 8 is arranged between the closed end of the mounting chamber 22 and the gap 10 for preventing from flowing back.

In this embodiment, the water supply waterway 200 arranged on the dispensing device 300 may be used as a first water supply waterway 201. The structure of the water inlet chamber and the water outlet chamber of the water supply waterway 200 in this embodiment corresponds to the structure of the first water inlet chamber 21 and the first water outlet chamber 23 of the first water supply waterway 201 of the dispensing device 300 in Embodiment 2, so the description thereof is not repeated.

In this embodiment, a second water supply waterway 202 is also provided, the second water supply waterway 202 is provided with a ventilation port 210, and the ventilation port 210 communicates with the water inlet chamber 33 in the dispensing device 300 through a ventilation passage 212. The gap 10 communicates with the ventilation passage 212 for enabling the backflow water to flow into the water inlet chamber 33 through the ventilation passage 212. Preferably, the front end of the water inlet chamber 33 is open and communicates with the atmosphere, and the gap 10 communicates with the outside atmosphere through the ventilation passage 212 and the water inlet chamber 33.

In this embodiment, the water supply waterway 200 is provided in the dispensing device 300 as the first supply waterway 201, and the second supply waterway 202 is provided in the same manner as in the dispensing device 300 of the second embodiment, and the description thereof is not repeated.

The above description is only a preferred embodiment of the present disclosure without limiting the disclosure in any manner. Although the present disclosure has been disclosed above in terms of preferred embodiments, it is not intended to limit the disclosure, any person familiar with the present patent, without departing from the scope of the technical solution of the present disclosure, can make some changes to the above-described embodiments and modify the embodiments into equivalent embodiments with equivalent changes using the teachings disclosed herein. Any simple modifications, equivalent changes, and modifications made to the above-described embodiments according to the technical essence of the present disclosure without departing from the content of the technical solution of the present disclosure still fall within the scope of the solution of the present disclosure.

The invention claimed is:

1. A dispensing device, comprising, a first water supply waterway, configured to supply water; and a second water supply waterway, configured to supply water; wherein, the first water supply waterway is provided with a gap for discharging backflow water in the first water supply waterway; and the second water supply waterway is provided with a ventilation port, the ventilation port is communicated with a water inlet chamber inside the dispensing device through a ventilation passage, and the gap is communicated with the ventilation passage for enabling the backflow water to flow into the water inlet chamber through the ventilation passage.

2. The dispensing device according to claim 1, wherein the first water supply waterway is provided with an ejector for allowing water flow to flow therethrough, wherein the ejector is provided with the gap, and the gap is used for communicating a flow channel inside the ejector with the ventilation passage.

3. The dispensing device according to claim 2, wherein the first water supply waterway comprises a first water inlet chamber and a first water outlet chamber, the second water supply waterway comprising a second water inlet chamber and a second water outlet chamber, an upper cover of the dispensing device being formed by connecting an upper cover plate with a lower cover plate by a snap-fitting manner;

the first water inlet chamber of the first water supply waterway, and the second water inlet chamber and the second water outlet chamber of the second water supply waterway are arranged between the upper cover plate and the lower cover plate;

an ejector and the first water outlet chamber of the first water supply waterway and a water passing chamber of the second water supply waterway are arranged at an upper side of the upper cover plate and upwardly protrude; and the ventilation passage being respectively in communication with the gap on the ejector of the first water supply waterway, and the second water outlet chamber of the second water supply waterway adjacent to the ventilation passage.

4. The dispensing device according to claim 1, wherein the dispensing device includes a water box, and an inner space of the water box forms the water inlet chamber communicating with the outside atmosphere; and wherein the ventilation passage, the first water supply waterway, and the second water supply waterway are integrally arranged on an upper cover at a top of the water box, an end of the ventilation passage communicates with the water inlet chamber, and another end of the ventilation passage communicates with the ventilation port of the second water supply waterway.

5. The dispensing device according to claim 4, wherein the first water supply waterway comprises a first water inlet chamber, a mounting chamber and a first water outlet chamber, an ejector is mounted in the mounting chamber;

wherein a water inlet and a water outlet of the ejector respectively communicate with the first water inlet chamber and the first water outlet chamber; and the gap is formed on the ejector, and the gap faces downward and communicates with the ventilation passage below the gap.

6. The dispensing device according to claim 4, wherein the first water supply waterway comprises a first water inlet chamber, a first water inlet pipeline, and a first water outlet chamber, the second water supply waterway comprising a second water inlet chamber, a water passing chamber and a second water outlet chamber;

an inlet of the second water inlet chamber communicates with a water inlet control valve through a second water inlet pipeline;

the water passing chamber is arranged above the second water inlet chamber;

the water passing chamber is provided with a water passing inlet and a water passing outlet, and the water passing inlet communicates with an outlet arranged at a top of the second water inlet chamber; and the second water outlet chamber is arranged below the water passing chamber and on one side of the first water outlet chamber, the water passing outlet communicates with a top of the second water outlet chamber, and a bottom of the water passing chamber is provided with a second water outlet connector for allowing water flow to flow out of the dispensing device.

7. The dispensing device according to claim 6, wherein a top of the side wall of the second water outlet chamber of the second water supply waterway is provided with the ventilation port; and the ventilation passage is extended horizontally and is arranged at one side of the second water outlet chamber, and the ventilation port communicates with an end of the ventilation passage, and another end of the ventilation passage is provided with an opening communicating with the water inlet chamber below.

8. The dispensing device according to claim 7, wherein an ejector in the first water supply waterway is located above the opening of the ventilation passage, and the gap on the ejector faces downward and corresponds to the opening below, for directly communicating the gap of the ejector with the water inlet chamber of the water box through the opening.

9. A dispensing device, comprising, a water supply waterway;

wherein the water supply waterway is provided with a water inlet chamber and a water outlet chamber at different height levels, and the water inlet chamber communicates with the water outlet chamber via an ejector; and wherein the ejector is provided with a gap for discharging backflow water in the water supply waterway.

10. The dispensing device according to claim 9, wherein the ejector is arranged in a same height level as the water outlet chamber; and wherein the water inlet chamber communicates with a water inlet of the ejector via a mounting chamber; and wherein a water outlet of the ejector communicates with the water outlet chamber.

11. The dispensing device according to claim 10, wherein the ejector is arranged in the mounting chamber;

wherein a periphery of the ejector is provided with a sealing ring, the sealing ring being in hermetical contact with the inner wall of the mounting chamber, for dividing the mounting chamber into two separate parts; and wherein an upstream part of the mounting chamber communicates with the water inlet chamber and the water inlet of the ejector.

12. The dispensing device according to claim 9, wherein the water inlet chamber is arranged lower than the water outlet chamber;

wherein a bottom of one end of the water inlet chamber communicates with a water inlet connector of the dispensing device; and wherein a top of another end of the water inlet chamber is provided with an outlet communicating with a water inlet of the ejector.

13. The dispensing device according to claim 9, wherein the water outlet chamber is coaxial with the ejector, and two ends of the water outlet chamber respectively communicate a water outlet of the ejector and a water outlet connector of the dispensing device.

14. The dispensing device according to claim 9, wherein the dispensing device includes a water box, a top wall of the water box is formed by an upper cover, and the water supply waterway is integrally arranged on the upper cover; and wherein the upper cover is formed by connecting an upper cover plate with a lower cover plate by a snap-fitting manner, the water outlet chamber and the ejector are arranged on the upper cover plate and upwardly protrude, and the water inlet chamber is arranged between the upper cover plate and the lower cover plate.

15. The dispensing device according to claim 9, wherein the dispensing device is provided with a ventilation passage communicating with the atmosphere; and wherein the ventilation passage is arranged at a same height level as the water inlet chamber, and the gap on the ejector directly communicates with the ventilation passage.

16. The dispensing device according to claim 15, wherein the ventilation passage is arranged between an upper cover plate and a lower cover plate of an upper cover of the dispensing device;

wherein at least part of the ventilation passage is arranged below the gap of the ejector; and wherein the gap on the ejector is in communication with the ventilation passage below the gap via an opening formed on the upper cover plate.

17. The dispensing device according to claim 15, wherein the ventilation passage is provided with an opening located below the gap of the ejector;

wherein the opening enables the ventilation passage to communicate with a water inlet chamber inside a water box; and wherein the water inlet chamber is provided with an opening at the front end of the water box for enabling the ventilation passage to communicate with the outside atmosphere through the water inlet chamber.

* * * * *